US008833123B2

(12) United States Patent
Ogura et al.

(10) Patent No.: US 8,833,123 B2
(45) Date of Patent: Sep. 16, 2014

(54) METHOD FOR MANUFACTURING BRANCHED PIPE AND BRANCHED PIPE MANUFACTURING DEVICE

(75) Inventors: Taiki Ogura, Hirakata (JP); Tatsushi Itou, Hirataka (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/583,849

(22) PCT Filed: Jul. 28, 2011

(86) PCT No.: PCT/JP2011/067357
§ 371 (c)(1),
(2), (4) Date: Sep. 10, 2012

(87) PCT Pub. No.: WO2012/015007
PCT Pub. Date: Feb. 2, 2012

(65) Prior Publication Data

US 2013/0000373 A1 Jan. 3, 2013

(30) Foreign Application Priority Data

Jul. 30, 2010 (JP) ..... 2010-171971

(51) Int. Cl.

| | |
|---|---|
| ***B21D 26/02*** | (2011.01) |
| ***B21D 22/12*** | (2006.01) |
| ***B21C 37/29*** | (2006.01) |
| ***B21D 35/00*** | (2006.01) |
| ***B21D 28/28*** | (2006.01) |

(52) U.S. Cl.
CPC ..... *B21D 22/125* (2013.01); *B21C 37/294* (2013.01); *B21D 35/001* (2013.01); *B21D 28/28* (2013.01)
USPC ..... 72/55; 72/61; 72/370.22

(58) Field of Classification Search
USPC ..... 72/54, 55, 57, 58, 60–62, 465.1, 466.8, 72/370.22; 29/421.1
See application file for complete search history.

(56) References Cited

U.S. PATENT DOCUMENTS

| | | | | | |
|---|---|---|---|---|---|
| 3,451,113 | A * | 6/1969 | Holden | 29/890.148 |
| 3,495,486 | A * | 2/1970 | Fuchs, Jr. | 72/55 |
| 3,815,394 | A * | 6/1974 | Walker | 72/55 |
| 4,513,497 | A * | 4/1985 | Finch | 72/62 |
| 6,497,128 | B1 * | 12/2002 | Canfield et al. | 72/61 |
| 2006/0086166 | A1 | 4/2006 | Hellgren | |

FOREIGN PATENT DOCUMENTS

| | | | | |
|---|---|---|---|---|
| DE | 10 2007 017 190 | A1 | 4/2008 | |
| JP | 44-7626 | | 4/1969 | |
| JP | 51-54135 | U | 4/1976 | |
| JP | 55-144334 | A1 | 11/1980 | |
| JP | 55144334 | A * | 11/1980 | B21D 26/02 |
| JP | 7-275973 | A | 10/1995 | |
| JP | 2000-117341 | A | 4/2000 | |
| JP | 2001-286944 | A | 10/2001 | |
| JP | 2004-1022 | A | 1/2004 | |
| JP | 2007-105788 | A | 4/2007 | |

* cited by examiner

*Primary Examiner* — Shelley Self
*Assistant Examiner* — Pradeep C Battula
(74) *Attorney, Agent, or Firm* — Global IP Counselors, LLP

(57) ABSTRACT

A method of manufacturing a branched pipe includes: a first swelling step of swelling a swelled part from a main body of a pipe blank by pressurizing the inner surface of the pipe blank by an elastic body, and simultaneously, forming an opening in the tip portion of the swelled part along a circumferential direction; and a second swelling step of swelling the swelled part from the main body by pressurizing the inner surface of the pipe blank by the elastic body.

5 Claims, 22 Drawing Sheets

METHOD FOR MANUFACTURING BRANCHED PIPE AND BRANCHED PIPE MANUFACTURING DEVICE

CROSS-REFERENCE TO RELATED APPLICATIONS

This application claims priority to Japanese Patent Application No. 2010-171971 filed on Jul. 30, 2010, the disclosure of which is hereby incorporated herein by reference in its entirety

TECHNICAL FIELD

The present invention relates to a method of manufacturing a branched pipe of a pipe blank and a branched pipe manufacturing device.

BACKGROUND ART

A method of manufacturing a branched pipe whereby a pipe blank is partially swelled by pressurizing the inner surface of the pipe blank has been widely known. According to such a manufacturing method, a swelled part can be swelled from a main body of the pipe blank.

Now, methods of simultaneously recessing and swelling a tip portion of the swelled part have been proposed for uniformly forming the thickness of the swelled part (see Japan Laid-open Patent Application Publication Nos. JP-A-2000-117341 and JP-A-S55-144334).

SUMMARY

However, in the methods described in Japan Laid-open Patent Application Publication Nos. JP-A-2000-117341 and JP-A-S55-144334, fluidity of material is limited in the recess formed in the tip portion of the swelled part. Therefore, growth of the swelled part is inhibited.

On the other hand, when pressure applied to the inner surface of the pipe blank is increased for forcibly promoting growth of the swelled part, the thickness of the periphery of the recess is acutely reduced and this easily produces a crank in the swelled part.

In the conventional arts, it is thus difficult to increase the swelled width of the swelled part from the main body (hereinafter referred to as "a swelled width") in a direction that the swelled part is swelled from the main body.

The present invention has been produced in view of the aforementioned situation and aims at providing a method of manufacturing a branched pipe and a branched pipe manufacturing device whereby the swelled width of a swelled part can be increased.

A method of manufacturing a branched pipe according to a first aspect of the present invention includes an elastic body loading step of loading an elastic body in an inside of a pipe blank; a first swelling step of swelling a swelled part to be formed by partially swelling a main body of the pipe blank through pressurization of an inner surface of the pipe blank by the elastic body and simultaneously firming an opening in a tip portion of the swelled part along a predetermined direction; and a second swelling step of further swelling the swelled part from the main body through pressurization of the inner surface of the pipe blank by the elastic body after execution of the first swelling step.

According to the method of manufacturing a branched pipe of the first aspect of the present invention, the swelled part is further swelled after the opening is formed. Therefore, it is possible to enhance material fluidity from the opening. Growth of the swelled part can be thereby promoted. As a result, it is possible to increase the swelled width of the swelled part from the main body.

A method of manufacturing a branched pipe according to a second aspect of the present invention relates to the method of manufacturing a branched pipe according to the first aspect of the present invention, the first swelling step includes forming a slit along the predetermined direction as the opening.

According to the method of manufacturing a branched pipe of the second aspect of the present invention, an elongated opening can be simply and efficiently formed.

A method of manufacturing a branched pipe according to a third aspect of the present invention relates to the method of manufacturing a branched pipe according to the first aspect of the present invention, the first swelling step includes firming a plurality of holes along the predetermined direction as the opening.

According to the method of manufacturing a branched pipe of the third aspect of the present invention, an opening can be simply formed with small pressure.

A method of manufacturing a branched pipe according to a fourth aspect of the present invention relates to the method of manufacturing a branched pipe according to one of the first to third aspects of the present invention, the first swelling step includes forming the opening in annular shape.

According to the method of manufacturing a branched pipe of the fourth aspect of the present invention, a disc portion is cut out from the tip of the swelled part, and thereby constraint in the tip of the swelled part can be efficiently resolved. As a result, it is possible to further enhance material fluidity.

A method of manufacturing a branched pipe according to a fifth aspect of the present invention relates to the method of manufacturing a branched pipe according to one of the first to fourth aspects of the present invention, the elastic body is a columnar body formed by an elastic member, and the first swelling step and the second swelling step include pressuring the inner surface of the pipe blank by compressing the columnar body in an axial direction.

According to the method of manufacturing a branched pipe of the fifth aspect of the present invention, it is possible to uniformly pressurize the inner surface of the pipe blank from the cylindrical surface of the columnar body.

A method of manufacturing a branched pipe according to a sixth aspect of the present invention relates to the method of manufacturing a branched pipe according to one of the first to fourth aspects of the present invention, the elastic body is a pouch-shaped body formed by an elastic member; the pouch-shaped body allowing a liquid to be injected therein, and the first swelling step and the second swelling step include pressuring the inner surface of the pipe blank by injecting the liquid into the pouch-shaped body.

According to the method of manufacturing a branched pipe of the sixth aspect of the present invention, it is possible to eliminate necessity of providing equipment for compressing the elastic body in itself.

A branched pipe manufacturing device according to a seventh aspect of the present invention includes a shaping die including a pipe hole and a branched hole, the pipe hole accommodating a pipe blank, and the branched hole extended outwards of the pipe hole from the pipe hole; an opening forming mold disposed along a predetermined direction when an inside of the branched hole is viewed from an inside of the pipe hole, the opening forming mold including an opening forming portion sharply protruded towards the pipe hole; and a pressurizing part configured to pressure the shaping die.

According to the branched pipe manufacturing device of the seventh aspect of the present invention, it is possible to form the opening along the predetermined direction in the swelled part swelled into the branched hole by the opening forming portion. Further, it is possible to further swell the swelled part by the pressurizing part after the opening is formed. Therefore, it is possible to enhance material fluidity from the opening as a base point, and growth of the swelled part can be thereby promoted. As a result, it is possible to increase the swelled width of the swelled part from the main body.

A branched pipe manufacturing device according to an eighth aspect of the present invention relates to the branched pipe manufacturing device according to the seventh aspect of the present invention, the opening forming portion is a cutting blade disposed along a circumferential direction of the branched hole.

According to the branched pipe manufacturing device of the eighth aspect of the present invention, an elongated hole can be simply and efficiently formed.

A branched pipe manufacturing device according to a ninth aspect of the present invention relates to the branched pipe manufacturing device according to the eighth aspect of the present invention, the opening forming portion is formed by an outer peripheral surface and an inner peripheral surface slanted against the outer peripheral surface at an acute angle.

A branched pipe manufacturing device according to a tenth aspect of the present invention relates to the branched pipe manufacturing device according to the seventh aspect of the present invention, the opening forming portion is formed by a plurality of cones aligned along a circumferential direction of the branched hole.

According to the branched pipe manufacturing device of the tenth aspect of the present invention, an opening can be simply formed with small pressure.

A branched pipe manufacturing device according to an eleventh aspect of the present invention relates to the branched pipe manufacturing device according to one of the seventh to ninth aspects of the present invention, the opening forming mold includes a groove portion disposed along the opening forming portion when viewed from the inside of the pipe hole.

According to the branched pipe manufacturing device of the eleventh aspect of the present invention, a portion of the swelled part, which is disposed adjacent to a contact portion of the swelled part making contact with the opening forming portion, can be locally swelled into the groove portion. Therefore, the swelled part can be thinned in a pinpoint manner, and an opening can be thereby efficiently formed.

A branched pipe manufacturing device according to a twelfth aspect of the present invention relates to the branched pipe manufacturing device according to the tenth aspect of the present invention, the groove portion is disposed outside the opening forming portion in relation to a center line of the branched hole as a reference, and the groove portion includes a bottom surface and a lateral surface slanted towards a tip of the opening forming portion from the bottom surface.

According to the branched pipe manufacturing device of the twelfth aspect of the present invention, the outer edge of the opening of the swelled part is quickly pressed onto the lateral surface of the groove portion when the opening is formed in the swelled part. Therefore, it is possible to inhibit a clearance from being produced between the outer edge of the opening and the lateral surface. As a result, it is possible to inhibit the elastic material forming the elastic body from leaking out of the opening.

A branched pipe manufacturing device according to a thirteenth aspect of the present invention relates to the branched pipe manufacturing device according to one of the tenth and eleventh aspects of the present invention, the opening forming mold includes a protruding portion disposed on an opposite side of the opening forming portion through the groove portion.

According to the branched pipe manufacturing device of the thirteenth aspect of the present invention, it is possible to restrict material flow into between the opening forming portion and the protruding portion in the tip portion of the swelled part. As a result, the swelled part can be quickly thinned at a predetermined position, and an opening can be thereby efficiently formed.

A branched pipe manufacturing device according to a fourteenth aspect of the present invention relates to the branched pipe manufacturing device according to one of the seventh to thirteenth aspects of the present invention, the opening forming mold includes a contact portion disposed inside the opening forming portion, and the contact portion includes a flat contact surface arranged perpendicularly to the center line of the branched hole.

According to the branched pipe manufacturing device of the fourteenth aspect of the present invention, material fluidity can be further enhanced within the swelled part by causing the tip portion of the swelled part to make contact with the contact surface. It is thereby possible to efficiently form an opening by the opening forming portion.

A branched pipe manufacturing device according to a fifteenth aspect of the present invention relates to the branched pipe manufacturing device according to one of the seventh to twelfth aspects of the present invention, the opening forming mold is fixed to the shaping die.

A branched pipe manufacturing device according to a sixteenth aspect of the present invention relates to the branched pipe manufacturing device according to the thirteenth aspect of the present invention, the opening thrilling mold is attachable to the shaping die, and detachable from the shaping die.

According to the present invention, it is possible to provide a method of manufacturing a branched pipe and a branched pipe manufacturing device whereby the swelled width of a swelled part can be increased.

DESCRIPTION OF THE EMBODIMENTS

Figure 1:
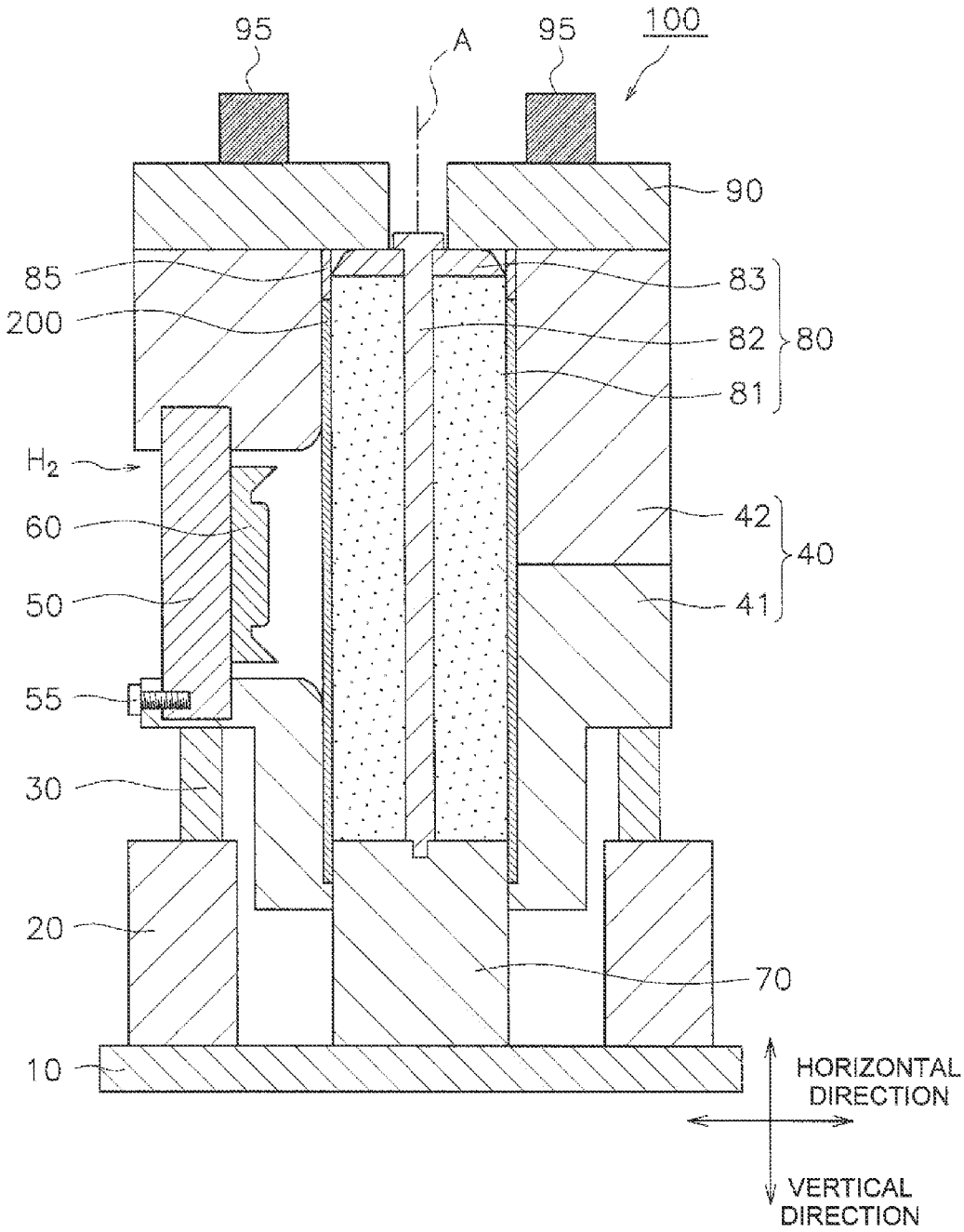
FIG. 1 is a cross-sectional view of the structure of a branched pipe manufacturing device 100 according to a first exemplary embodiment.

Next, an exemplary embodiment of the present invention will be explained using figures. In the following description of the figures, the same or similar reference numeral is given to the same or similar elements. It should be noted that the figures are schematic only and respective dimensional ratios and etc. of the figures may be different from actual ones. Therefore, specific dimensions and etc. should be judged in view of the following explanation. Further, it is apparent that dimensional relations and ratios of corresponding parts/portions/sections are different among the figures.

First Exemplary Embodiment

Structure of Branched Pipe Manufacturing Device 100

The structure of a branched pipe manufacturing device 100 according to a first exemplary embodiment will be explained with reference to the figures. FIG. 1 is a cross-sectional view illustrating the structure of the branched pipe manufacturing device 100 according to the first exemplary embodiment. FIG. 1 illustrates a state of the branched pipe manufacturing device 100 that a pipe blank 200 is mounted.

It should be noted that a round straight pipe is assumed to be used as the pipe blank 200 in the first exemplary embodiment. However, the pipe blank 200 is not limited to the above. A rectangular straight pipe, a round or rectangular bent pipe and etc. can be used as the pipe blank 200.

The branched pipe manufacturing device 100 includes a base 10, a support part 20, a cushion pin 30, a shaping die 40, a basal part 50, an opening forming mold 60, a piston 70, a pressure transmission part 80, a pipe presser part 85, a plate 90 and hydraulic cylinders 95.

The base 10 forms the bottom part of the branched pipe manufacturing device 100.

The support part 20 is fixed onto the base 10. The support part 20 includes a built-in return spring (not illustrated in the figures) supporting the cushion pin 30.

The cushion pin 30 is supported by the support part. 20 while being slidable along a vertical direction. The cushion pin 30 is upwardly urged by the return spring along the vertical direction. The cushion pin 30 mitigates shock caused by the up-and-down movement of the shaping die 40.

The shaping die 40 is supported by the cushion pin 30 while being movable up and down along the vertical direction. The shaping die 40 includes a bottom die 41 and a top die 42.

Figure 2:
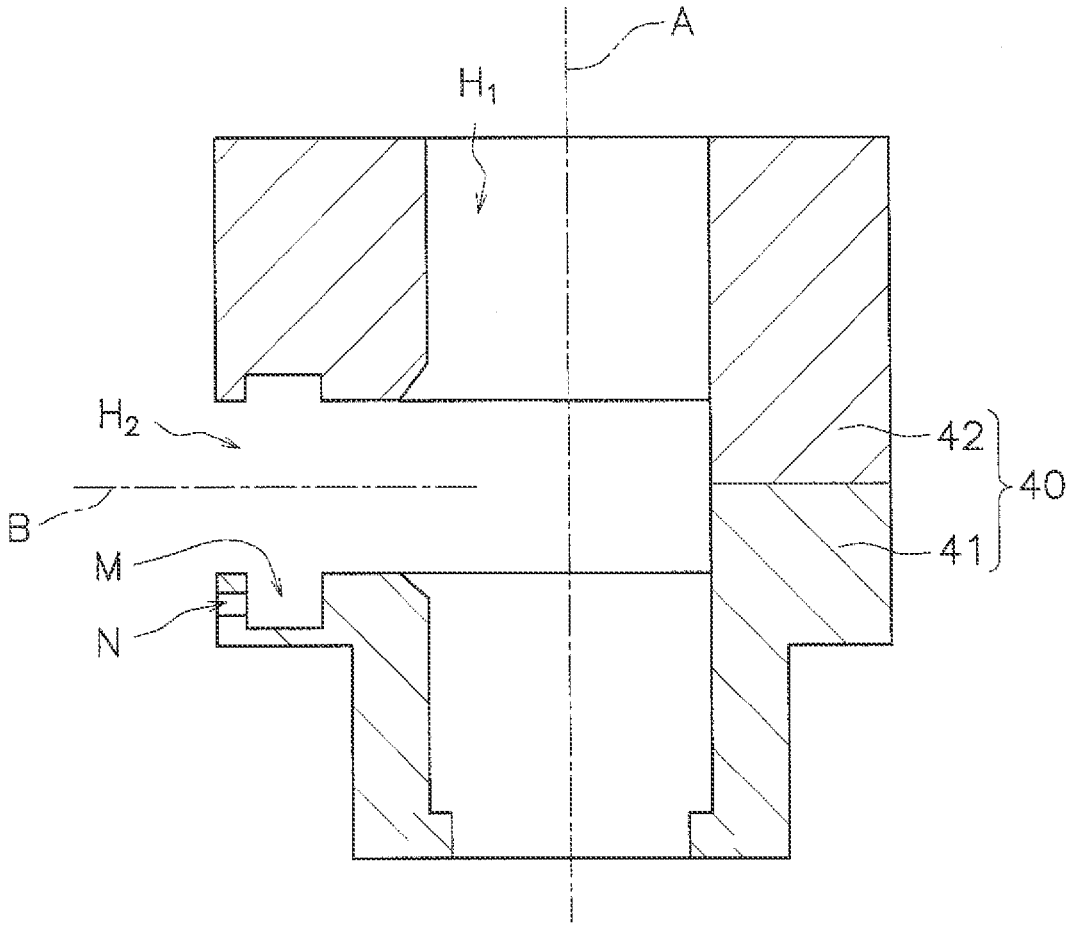
FIG. 2 is a cross-sectional view of the structure of a shaping die 40 according to the first exemplary embodiment.

FIG. 2 is herein a cross-sectional view illustrating the structure of the shaping die 40 according to the first exemplary embodiment. As illustrated in FIG. 2, the Shaping die 40 includes a pipe hole $H_1$, a branched hole $H_2$, a fitting groove M and a bolt hole N.

The pipe hole accommodates the pipe blank 200. The pipe hole penetrates the shaping die 40 from its bottom surface to its top surface. It should be noted in the first exemplary embodiment that a center line A of the pipe hole $H_1$ is arranged along the vertical direction (see FIG. 1).

The branched hole $H_2$ is extended to a radial outer side of the pipe hole $H_1$ from an inner surface of the pipe hole $H_1$. The branched hole $H_2$ penetrates from the inner surface of the pipe hole $H_1$ to a lateral surface of the shaping die 40. It should be noted in the first exemplary embodiment that a center line B of the branched hole $H_2$ is arranged perpendicularly to the center line A of the pipe hole $H_1$. Therefore, the center line B of the branched hole $H_2$ is arranged along a horizontal direction (see FIG. 1).

The fitting groove M is formed on the inner surface of the branched hole $H_2$. The fitting groove M is annularly formed about the center line B of the branched hole $H_2$. Although not illustrated in the figures, the lower half of the fitting groove M is formed on the bottom die 41, while the upper half of the fitting groove M is formed on the top die 42.

The bolt hole N penetrates from the inner surface of the fitting groove M to the lateral face of the shaping die 40.

The basal part 50 is fitted into the fitting groove M. The basal part 50 is detachably fixed to the shaping die 40 by means of a bolt 55 screwed into the bolt hole N. In the first exemplary embodiment, the basal part 50 clogs the branched hole $H_2$ in the axially intermediate part of the branched hole $H_2$.

The opening forming mold 60 is disposed in the branched hole FR The opening forming mold 60 is fixed to the pipe hole $H_1$ side of the basal part 50. Therefore, the opening forming mold 60 is detachably fixed to the shaping die 40 together with the basal part 50. As described below, the opening forming mold 60 forms an opening in a swelled part 300 (see FIG. 9) of the pipe blank 200. The structure of the opening forming mold 60 will be explained below.

The piston 70 is fixed onto the base 10. The piston 70 supports the pressure transmission part 80. The piston 70 is inserted into or pulled out of the pipe hole $H_1$ in conjunction with the up-and-down movement of the shaping die 40.

The pressure transmission part 80 includes an elastic body 81, a support shaft 82 and an elastic body presser part 83. The pressure transmission part 80 is configured to transmit pressure, applied thereto from the hydraulic cylinders 95 through the plate 90, to the inner surface of the pipe blank 200.

The elastic body 81 is a columnar body formed by an elastic member (e.g., rubber). The elastic body 81 is disposed along the center line A of the pipe hole $H_1$. The elastic body 81 is elastically deformed by the pressure applied thereto along the center line A.

The support shaft 82 is disposed along the center line A of the pipe hole $H_1$. The bottom end of the support shaft 82 is fixed to the piston 70. The support shaft 82 supports the elastic body 81 in a slidable state.

The elastic body presser part 83 is disposed on the elastic body 81. The elastic body presser part 83 is a plate member formed by, for instance, a metal member. The elastic body presser part 83 is slidable with respect to the support shaft 82. The elastic body presser part 83 is configured to transmit the vertically downward force received from the plate 90 to the elastic body 81.

The pipe presser part 85 is disposed between the pipe blank 200 and the plate 90. The pipe presser part 85 is an annular member formed by for instance, a metal member.

The plate 90 is disposed on the shaping die 40. The plate 90 is configured to transmit vertically downward force received from an actuator (not illustrated in the figures) to the shaping die 40, the elastic body presser part 83 and the pipe presser part 85.

The hydraulic cylinders 95 (exemplary pressurizing part) is disposed on the plate 90. The hydraulic cylinders 95 are configured to be driven by means of the pressurized oil supplied thereto from a hydraulic pump (not illustrated in the figures), and the hydraulic cylinders 95 can apply pressure to the shaping die 40 through the plate 90.

Structure of Opening Forming Mold 60

Figure 3:
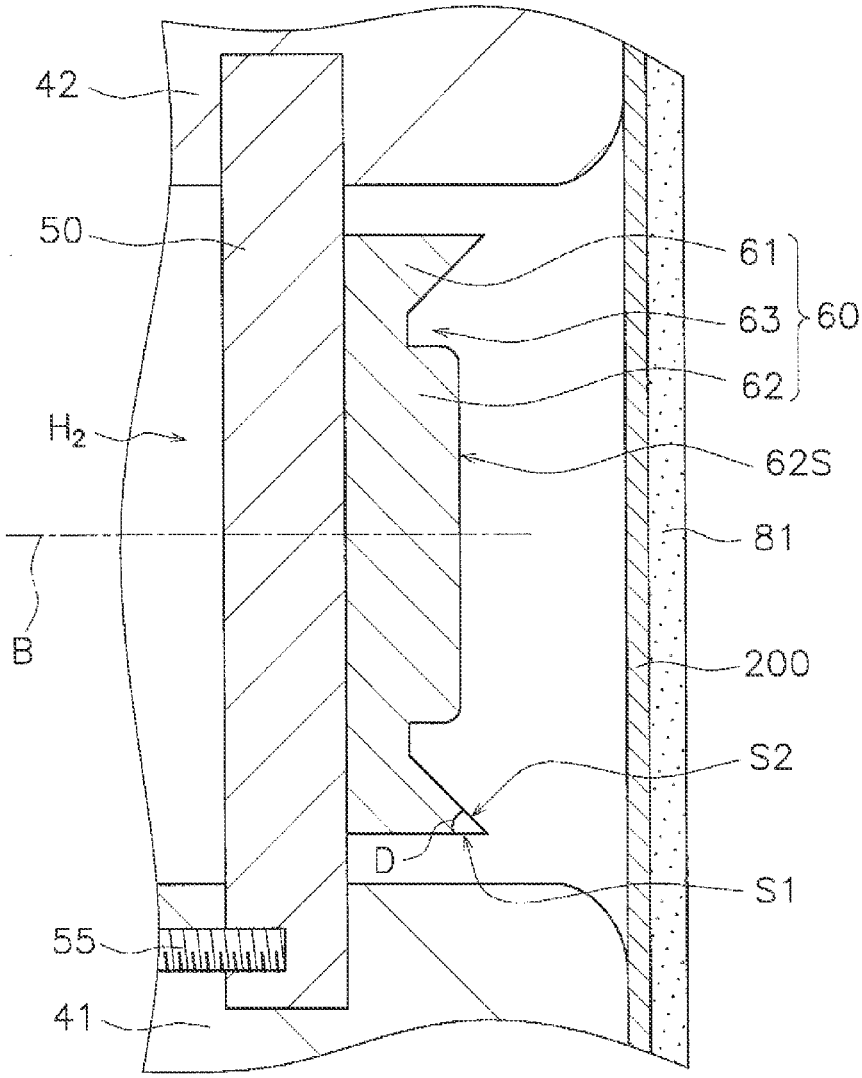
FIG. 3 is a partial enlarged view of FIG. 1.
Figure 4:
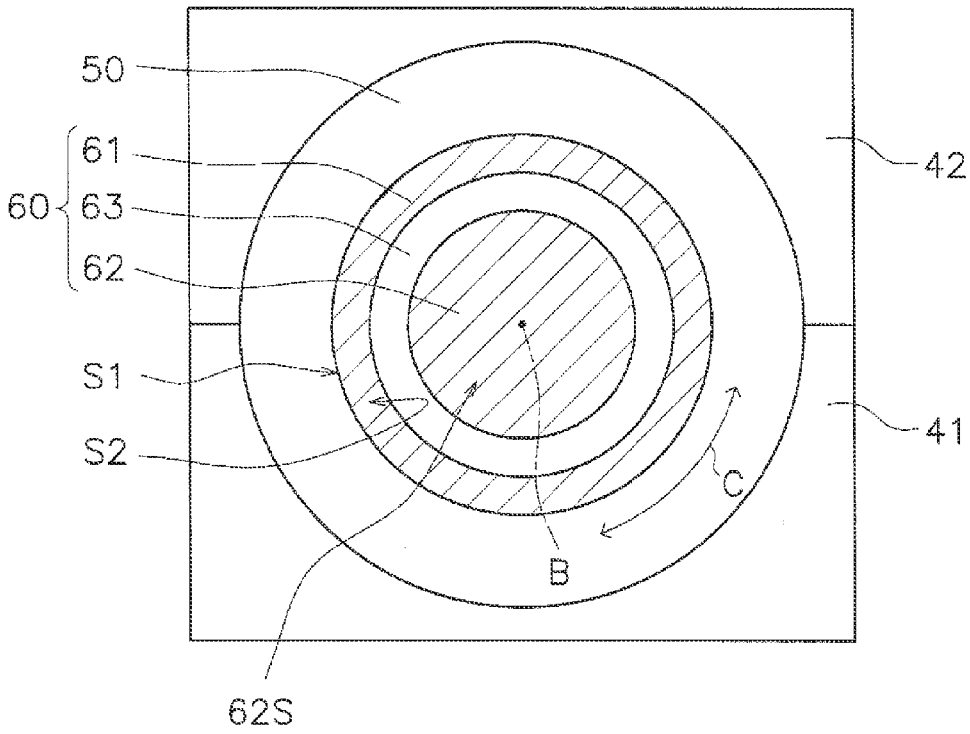
FIG. 4 is a plan view obtained when the inside of a branched hole $H_2$ is viewed from the inside of a pipe hole $H_1$.
Figure 5:
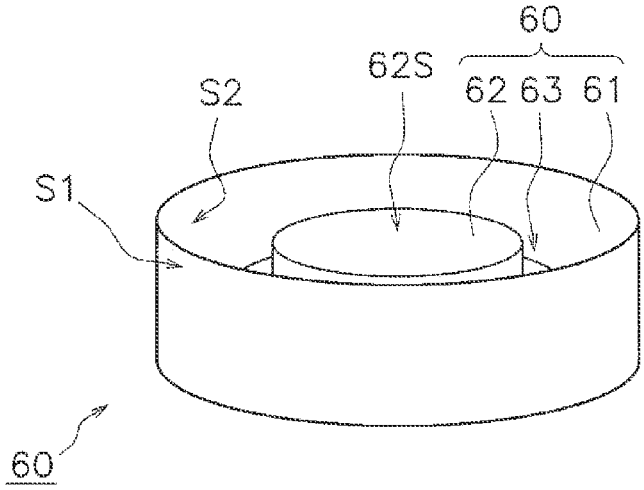
FIG. 5 is a perspective view of an opening forming mold 60 according to the first exemplary embodiment.

Next, the structure of the opening thrilling mold 60 according to the first exemplary embodiment will be explained with reference to the figures. FIG. 3 is a partial enlarged view of FIG. 1. FIG. 4 is a plan view obtained when the inside of the branched hole $H_2$ is viewed from the inside of the pipe hole $H_1$. FIG. 5 is a perspective view of the opening forming mold 60 according to the first exemplary embodiment.

The opening forming mold 60 includes an opening forming portion 61, a contact portion 62 and a groove portion 63.

The opening forming portion 61 is a cutting blade formed along a circumferential direction C (see FIG. 4) about the center line B of the branched hole $H_2$ when the inside of the branched hole $H_2$ is viewed from the inside of the pipe hole $H_1$. Specifically, the opening forming portion 61 includes an outer peripheral surface S1 and an inner peripheral surface S2 that forms an acute angle D (see FIG. 3) together with the outer peripheral surface S1. The outer peripheral surface S1 is arranged in parallel to the inner peripheral surface of the branched hole $H_2$, whereas the inner peripheral surface S2 is slanted with respect to the inner peripheral surface of the branched hole 147. The opening forming portion 61 is sharply protruded towards the pipe hole $H_1$.

The contact portion 62 is formed inside the opening forming portion 61 in relation to the center line B of the branched hole $H_2$ as a reference. The contact portion 62 is protruded towards the pipe hole $H_1$. The contact portion 62 is formed in the island shape enclosed by the opening forming portion 61. The contact portion 62 has a contact surface 62S arranged perpendicularly to the center line B of the branched hole $H_2$. The contact surface 62S is a flat surface extended perpendicularly to the center line B. As described below, the tip of the swelled part 300 makes contact with the contact surface 62S in a step of manufacturing a branched pipe, and thereby growth of the middle tip of the swelled part 300 is inhibited.

The groove portion 63 is formed inside the opening forming portion 61 in relation to the center line B of the branched hole $H_2$ as a reference. The groove portion 63 is annularly formed along the circumferential direction C between the opening forming portion 61 and the contact portion 62.

Method of Manufacturing Branched Pipe

Next, a method of manufacturing a branched pipe according to the first exemplary embodiment will be explained with reference to FIGS. 6 to 16.

Figure 6:
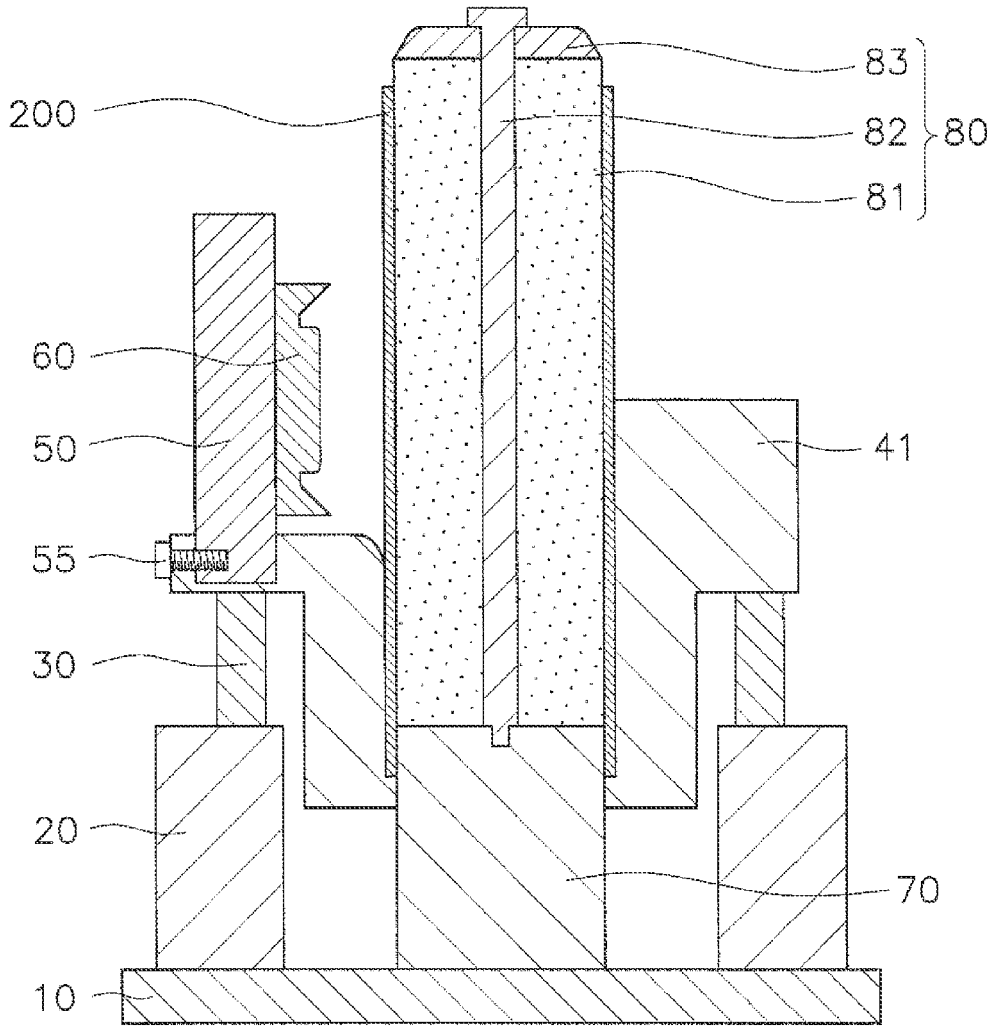
FIG. 6 is a diagram for explaining a method of manufacturing a branched pipe according to the first exemplary embodiment.

Next, as illustrated in FIG. 6, the pressure transmission part 80 is disposed on the piston 70. Specifically; the support shaft 82 is inserted into the pressure transmission part 80 from above the elastic body 81 and the elastic body presser part 83, both of which are disposed on the piston 70.

Figure 7:
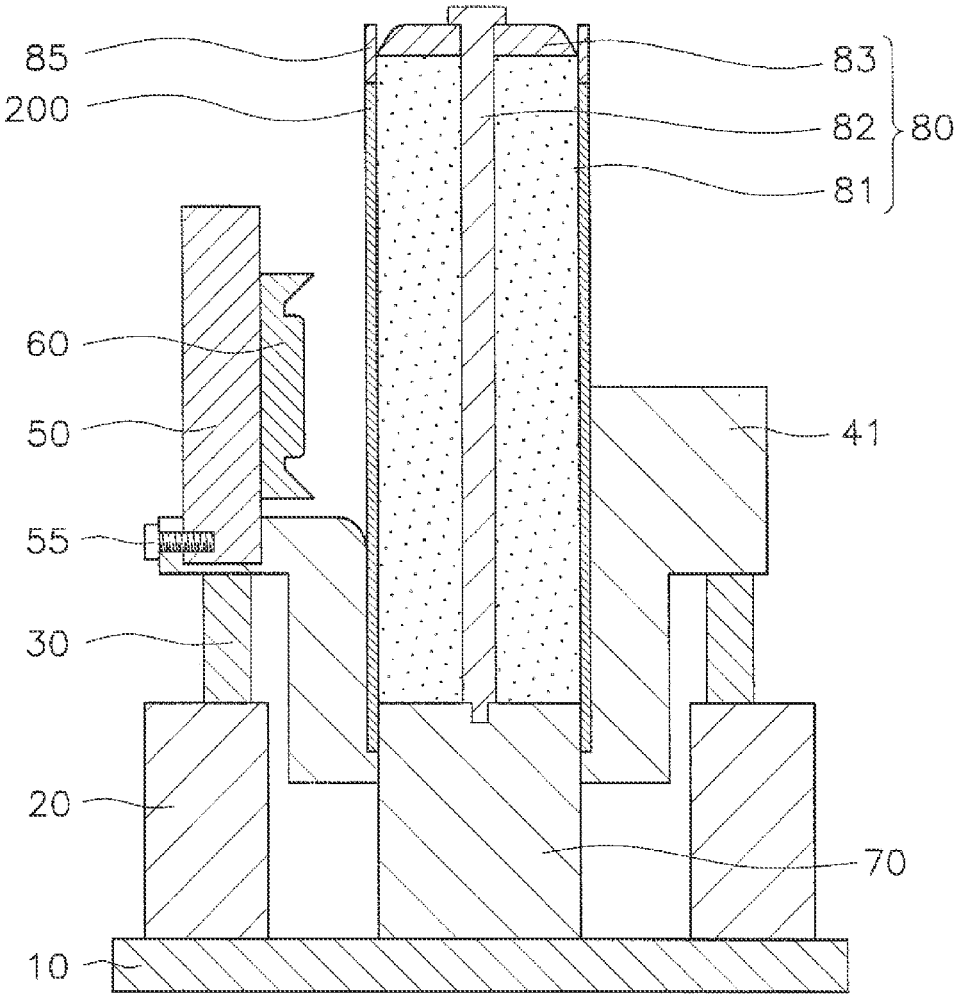
FIG. 7 is a diagram for explaining the method of manufacturing a branched pipe according to the first exemplary embodiment.

Next, as illustrated in FIG. 7, the elastic body 81 is loaded in the inside of the pipe blank 200 by mounting the pipe blank 200 onto the elastic body 81 from above. Subsequently, the pipe presser part 85 is disposed on the pipe blank 200.

Figure 8:
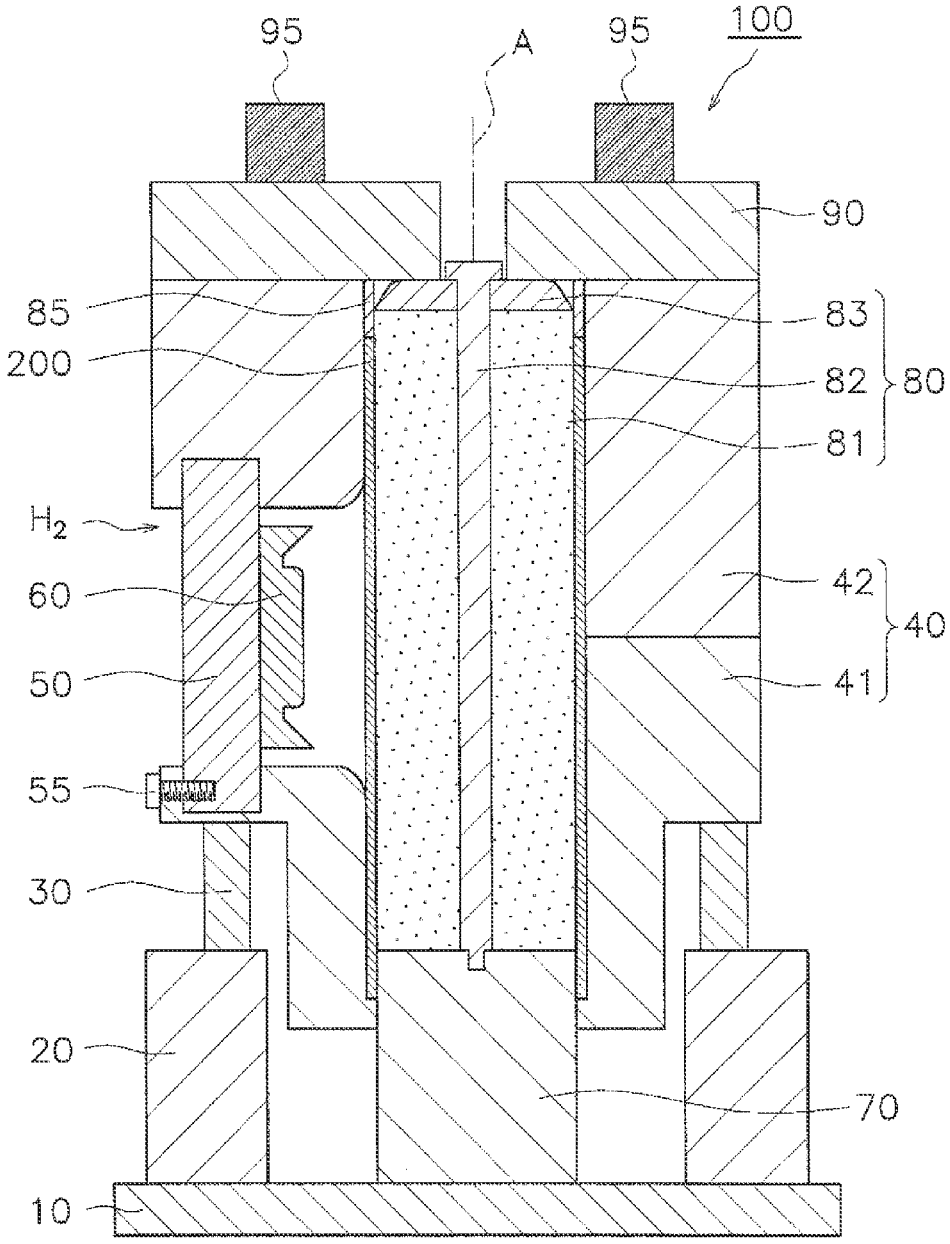
FIG. 8 is a diagram for explaining the method of manufacturing a branched pipe according to the first exemplary embodiment.

Next, as illustrated in FIG. 8, the shaping die 40 is assembled by fixing the top die 42 onto the bottom die 41. Subsequently; the plate 90 and the hydraulic cylinders 95 are sequentially disposed on the shaping die 40. Accordingly, the branched pipe manufacturing device 100 is completed.

Figure 9:
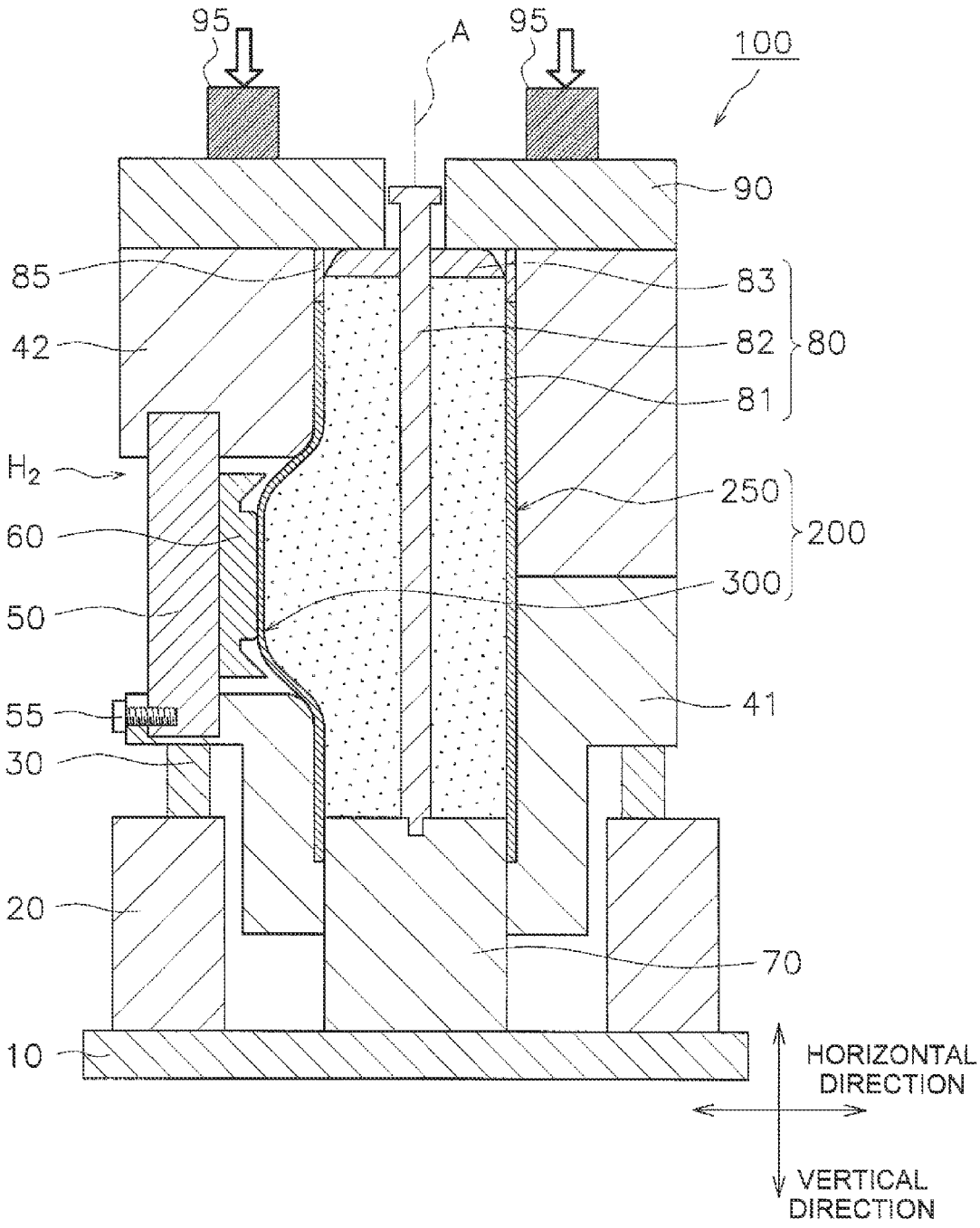
FIG. 9 is a diagram for explaining the method of manufacturing a branched pipe according to the first exemplary embodiment.

Next, as illustrated in FIG. 9, the inner surface of the pipe blank 200 is pressurized by the elastic body 81, and thereby a main body 250 of the pipe blank 200 is partially swelled and the swelled part 300 is thus formed. Specifically, the plate 90 is pressed vertically downwards by means of the actuator (not illustrated in the figures, and thereby the elastic body 81 and the pipe presser part 85 are compressed in the axial direction (i.e., the center line A direction of the pipe hole $H_1$). Pressure is thereby applied to the inner surface of the pipe blank 200 by the elastic body 81, and simultaneously, the pipe blank 200 in itself is compressed in the axial direction (i.e., the center line A direction of the pipe hole $H_1$).

Figure 10:
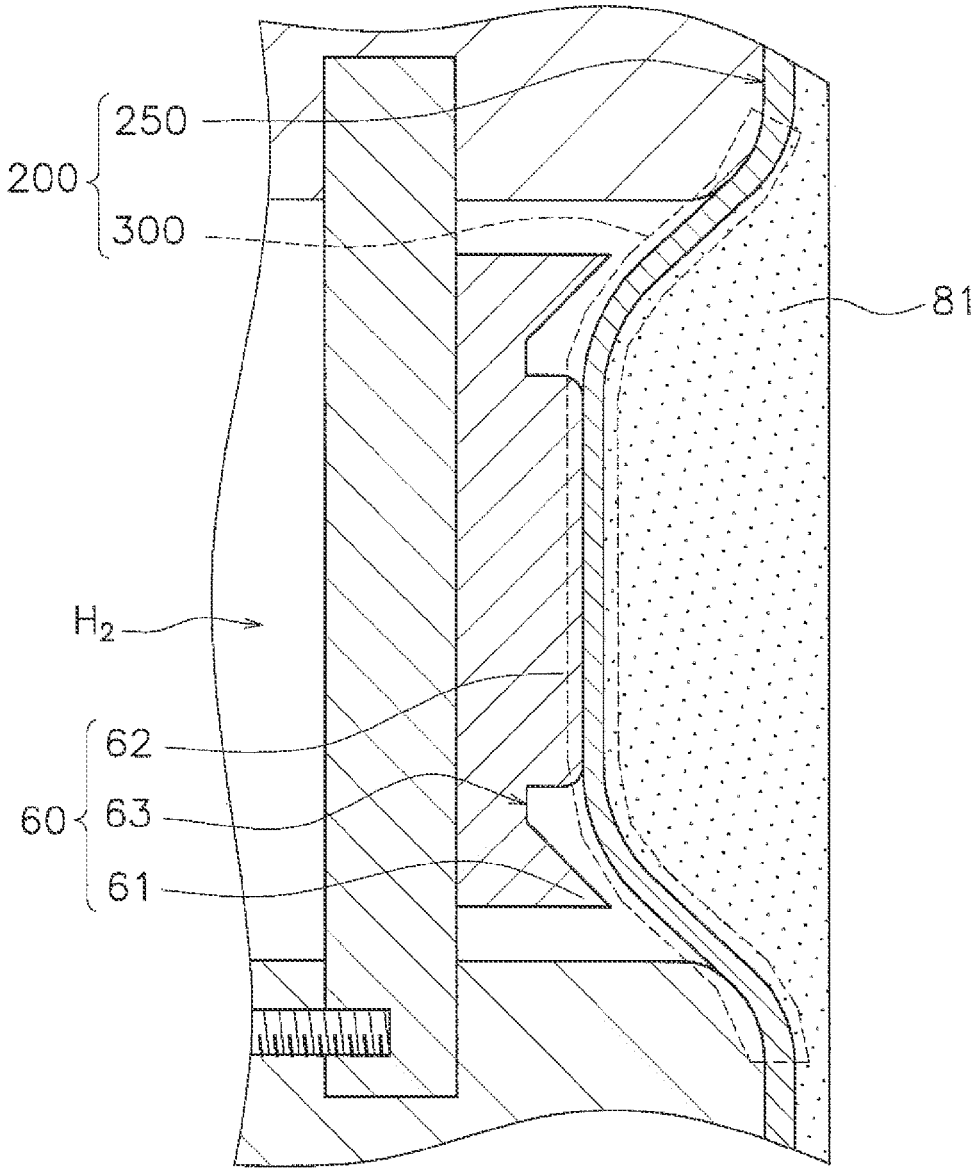
FIG. 10 is a diagram fir explaining the method of manufacturing a branched pipe according to the first exemplary embodiment.

FIG. 10 is herein a partial enlarged view of FIG. 9. The swelled part 300 starts swelling to the inside of the branched hole H from the main body 250. The tip portion of the swelled part 300 reaches the opening funning mold 60.

Next, the inner surface of the pipe blank 200 is further pressurized by the elastic body 81 and the swelled part 300 is accordingly further swelled.

Figure 11:
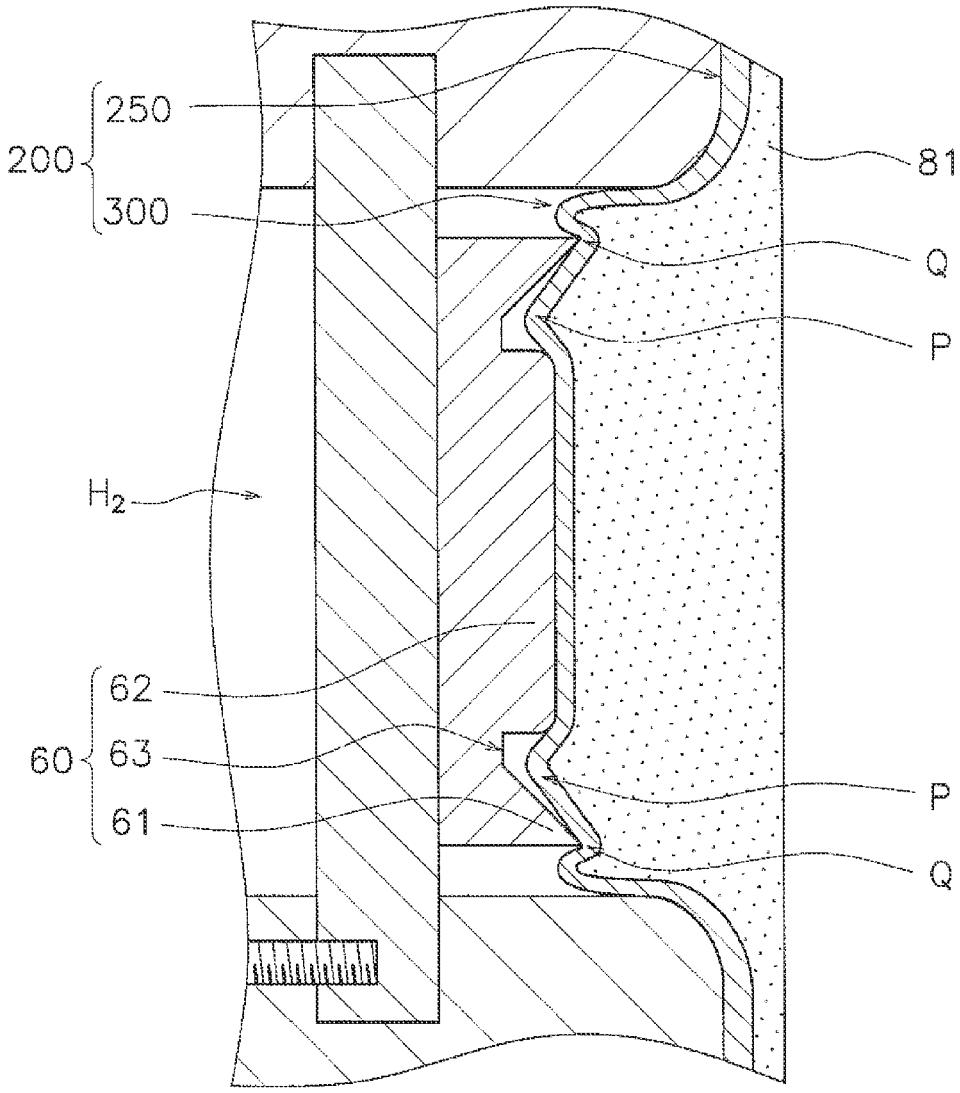
FIG. 11 is a diagram for explaining the method of manufacturing a branched pipe according to the first exemplary embodiment.

FIG. 11 herein illustrates a state that the inner surface of the pipe blank 200 is further pressurized by the elastic body 81 after the state illustrated in FIG. 10. A part of the swelled part 300, ranging from a contact portion with the opening forming portion 61 to a contact portion with the contact portion 62 (hereinafter referred to as "an annular portion P"), starts swelling to the inside of the groove portion 63. Simultaneously, the outer edge of the annular portion P is pressed onto the opening forming portion 61 and an annular recess Q is thereby formed. Thus, deformation allowance of the annular portion P is provided within the groove portion 63, while material flow to the annular portion P is restricted at the annular recess Q. Therefore, the swelled part 300 is thinned at the annular recess Q in a pinpoint manner.

Figure 12:
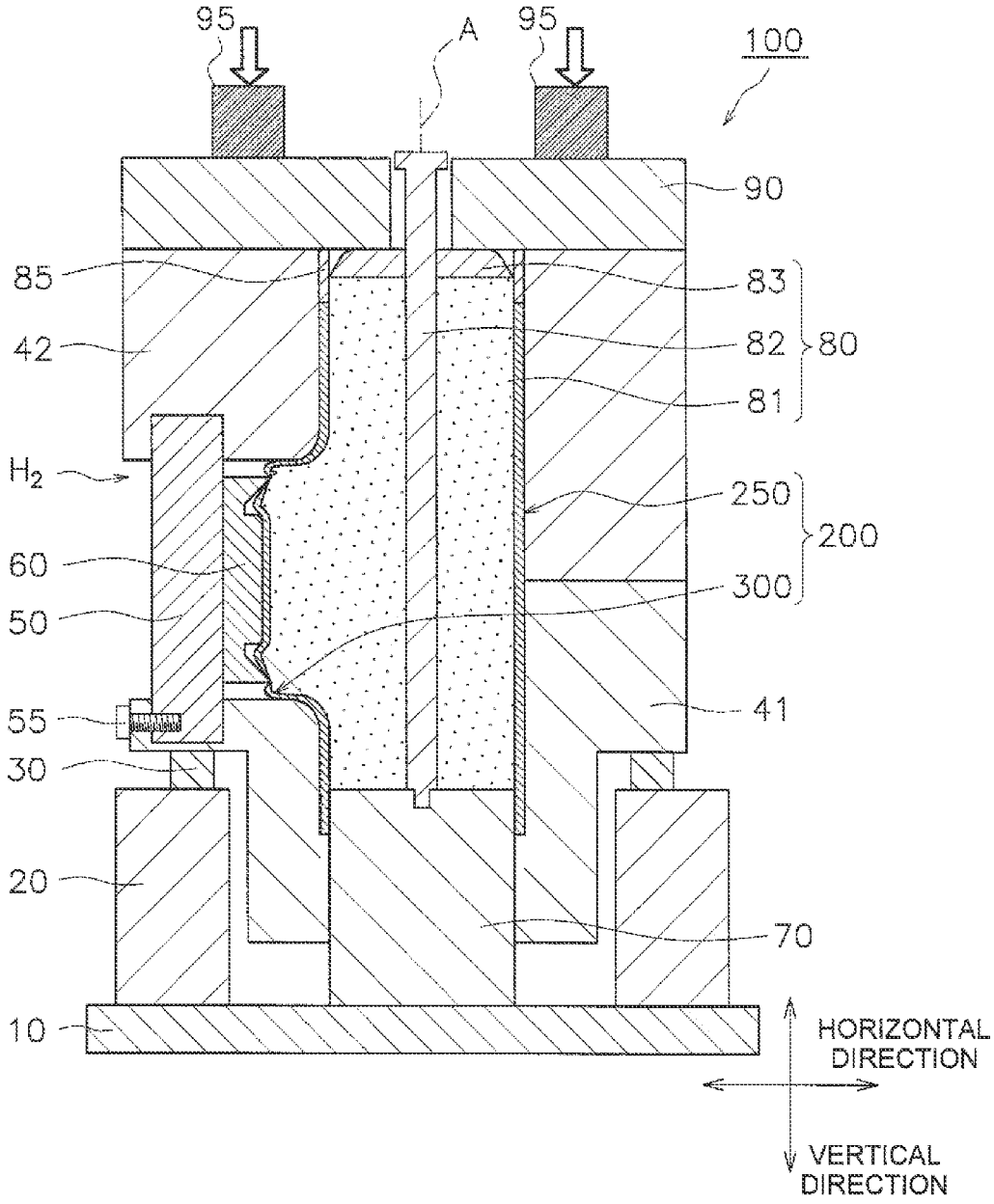
FIG. 12 is a diagram for explaining the method of manufacturing a branched pipe according to the first exemplary embodiment.

Next, as illustrated in FIG. 12, the inner surface of the pipe blank 200 is further pressurized by the elastic body 81, and thereby an opening is formed along the annular recess Q (see FIG. 11) in the tip portion of the swelled part 300 (hereinafter referred to as "a first swelling step").

Figure 13:
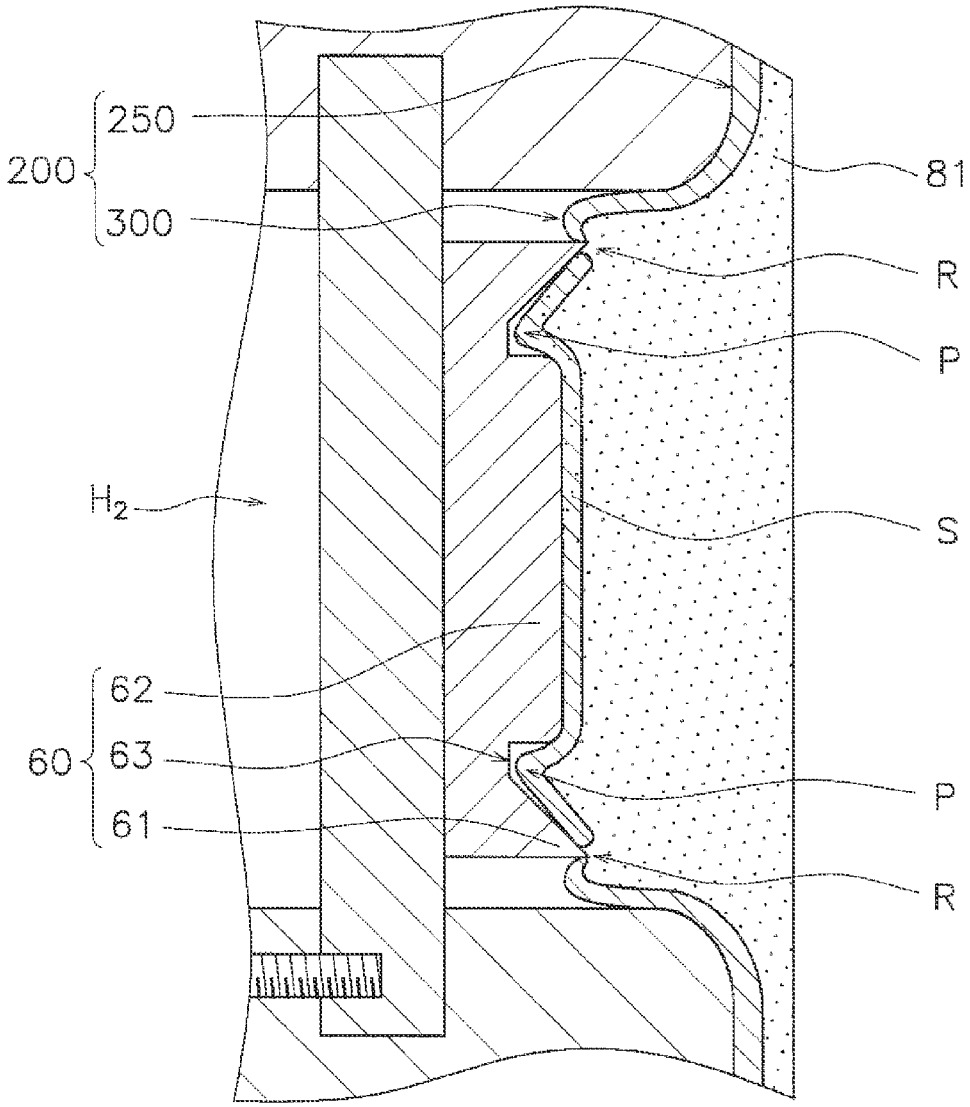
FIG. 13 is a diagram fir explaining the method of manufacturing a branched pipe according to the first exemplary embodiment.
Figure 14:
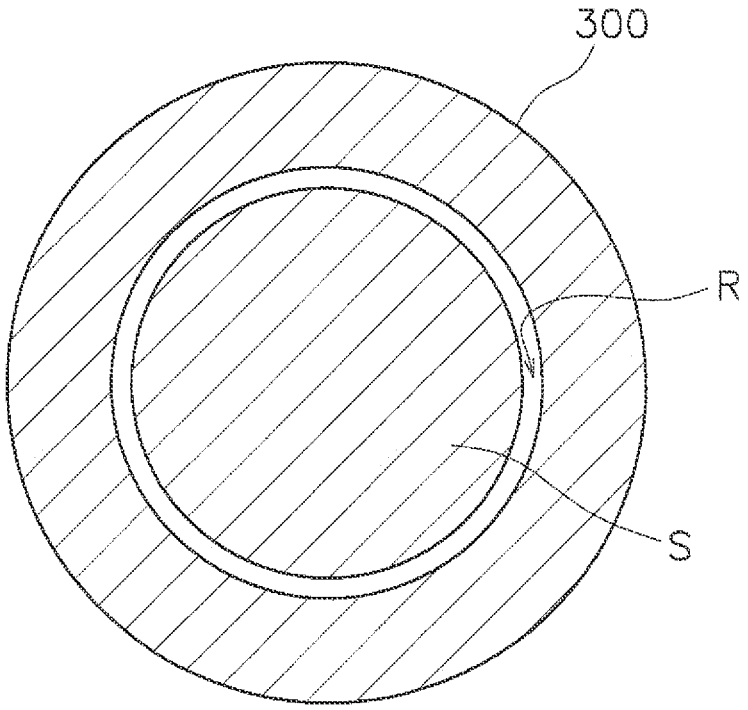
FIG. 14 is a diagram for explaining the method of manufacturing a branched pipe according to the first exemplary embodiment.

FIG. 13 is herein a partial enlarged view of FIG. 12. FIG. 14 is a plan view of the swelled part 300 illustrated in FIG. 13 viewed from the opening forming portion 61 side. The outer edge of the annular portion P is pressed onto and cut by the opening thrilling portion 61 functioning as a cutting blade. Accordingly, a slit R is formed along the circumferential direction C in the tip of the swelled part 300. In the first exemplary embodiment, the slit R is thus formed along the circumferential direction C as an opening. It should be noted that the slit R is annularly thrilled due to the opening forming portion 61 formed as an annular cutting blade as described above. As a result, a disc portion S is cut away from the tip portion of the swelled part 300.

Figure 15:
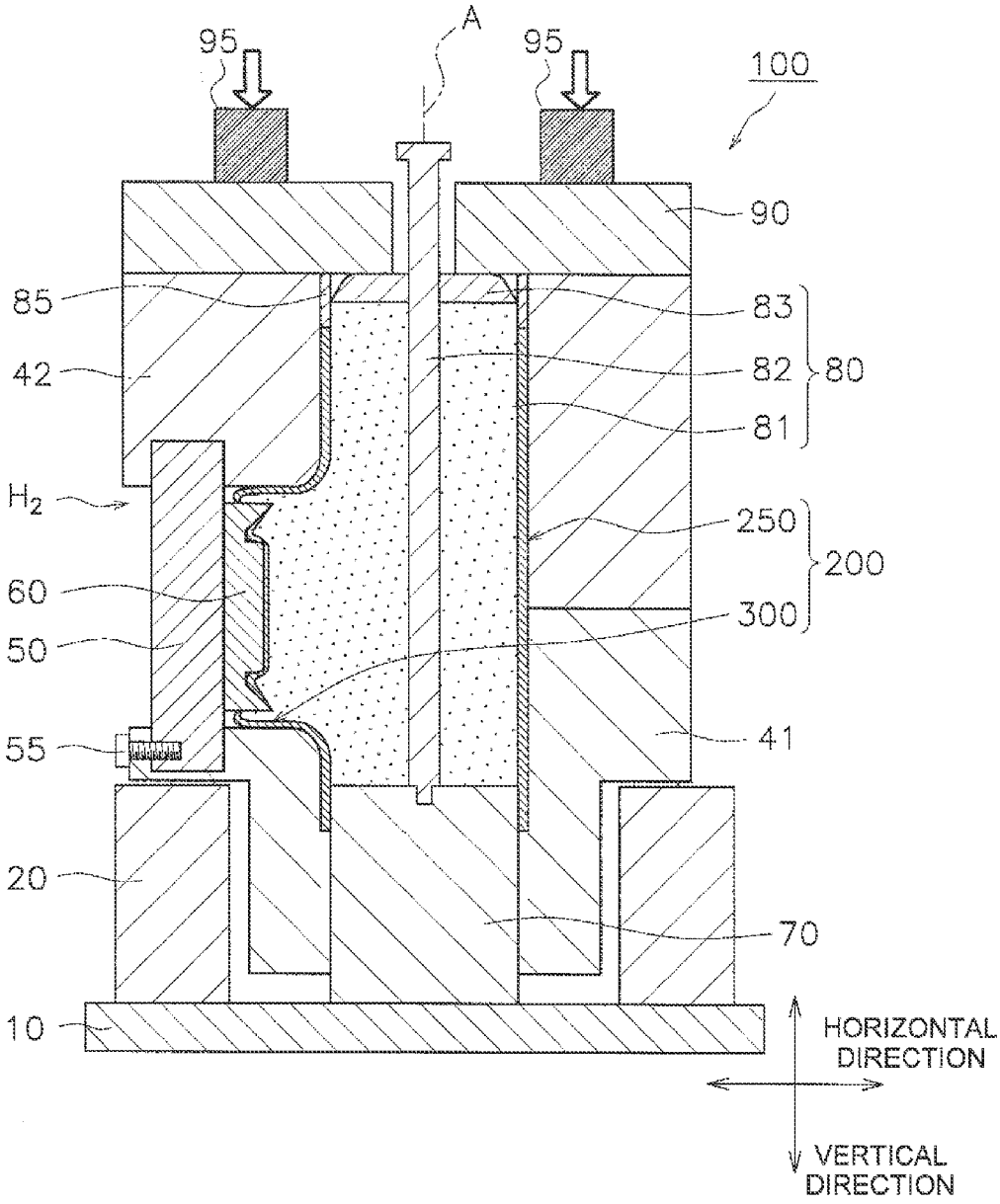
FIG. 15 is a diagram for explaining the method of manufacturing a branched pipe according to the first exemplary embodiment.

Next, as illustrated in FIG. 15, the inner surface of the pipe blank 200 is further pressurized by the elastic body 81, and thereby the swelled part 300 is further swelled (hereinafter referred to as "a second swelling step").

Figure 16:
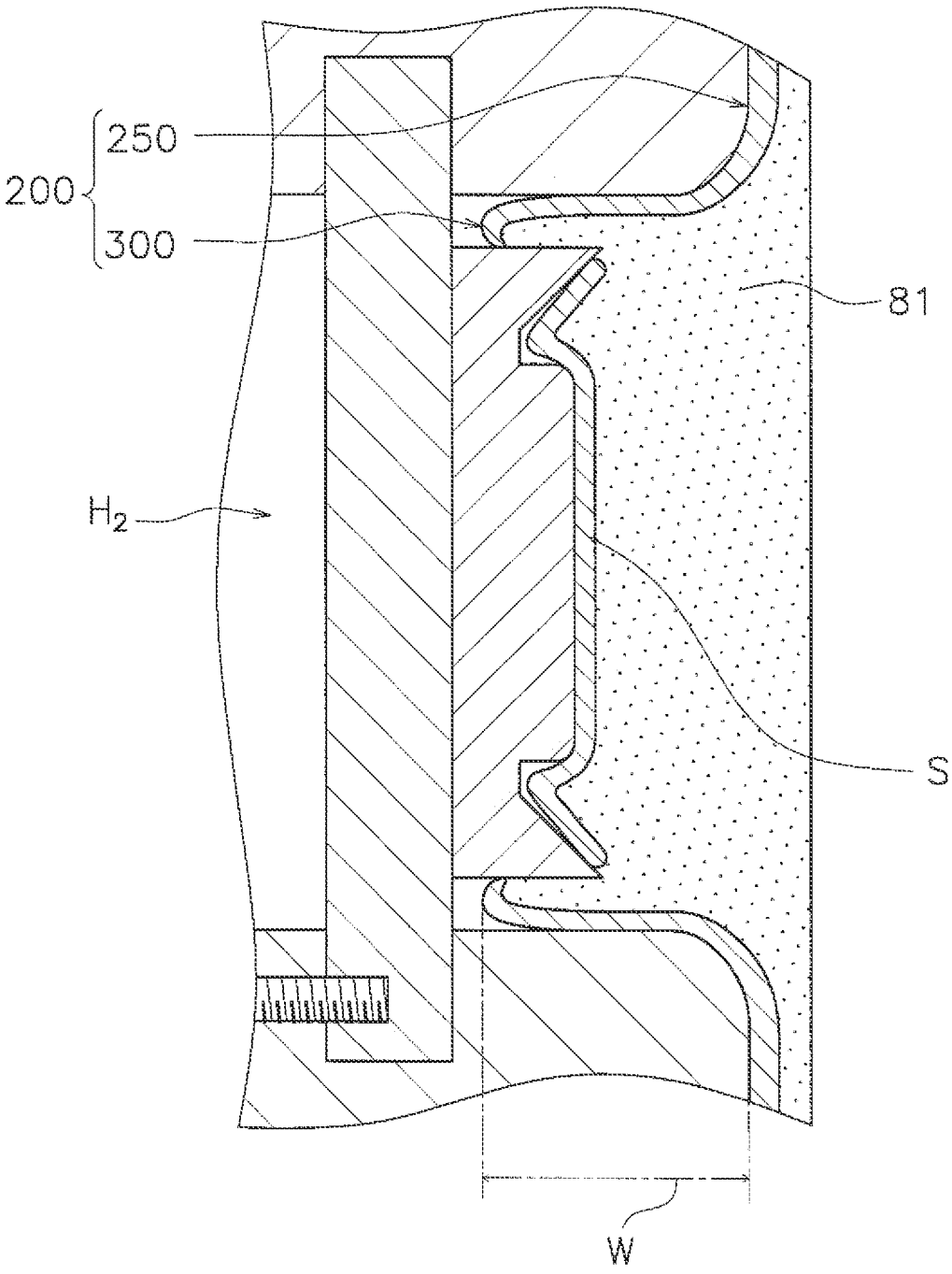
FIG. 16 is a diagram for explaining the method of manufacturing a branched pipe according to the first exemplary embodiment.

FIG. 16 is herein a partial enlarged view of FIG. 15. The tip portion of the swelled part 300 grows without being restricted by the disc portion S. Accordingly; the width of the swelled part 300 swelled from the main body 250 (hereinafter referred to as "a swelled width W") is increased in a direction that the swelled part 300 is swelled from the main body 250 (i.e., in a direction along the center line B). It should be noted that the disc portion S is left attached to the opening forming mold 60.

Next, pressurization by the actuator is released. The elastic body 81 is herein restored to its original shape by its elastic deformation.

Next, the shaping die 40 is disassembled, and then, the pipe blank 200 in which the swelled part 300 is formed is taken out.

Actions and Effects (1) A method of manufacturing a branched pipe according to the first exemplary embodiment includes the first swelling step and the second swelling step, in the first swelling step, the inner peripheral surface of the pipe blank 200 is pressurized by the elastic body 81 for swelling the swelled part 300 from the main body 250 of the pipe blank 200, and simultaneously, forming an opening (the slit R) along the circumferential direction C in the tip portion of the swelled part 300, and in the second swelling step, the inner surface of the pipe blank 200 is pressurized by the elastic body 81 for swelling the swelled part 300 from the main body 250.

According to the method of manufacturing a branched pipe according to the first exemplary embodiment, the swelled part 300 is further swelled after the opening is formed. Therefore, it is possible to flow material from the opening as a base point without being restricted. Therefore, growth of the swelled part 300 can be promoted. As a result, the swelled width W of the swelled part 300 from the main body 250 can be increased.

Further, the opening is formed in an elongated shape along the circumferential direction C. Therefore, it is possible to thither enhance material fluidity than the structure that the opening is formed as a small round hole.

Further, the elastic body 81 is used as the medium for pressurizing the inner surface of the pipe blank 200. Therefore, it is possible to further inhibit the medium from leaking out of the opening than the structure that liquid is used as the medium. Further, the elastic body 81 is restored to its original shape in response to release of pressurization. Therefore, the elastic body 81 can be repeatedly used as the medium.

(2) In the method of manufacturing a branched pipe according to the first exemplary embodiment, the slit R is formed along the circumferential direction C as an opening in the first swelling step. Therefore, the elongated opening can be simply and efficiently formed.

Further, in the method of manufacturing a branched pipe according to the first exemplary embodiment, the opening is formed in an annular shape. Therefore, the disc portion S is cut out of the tip of the swelled part 300, and thereby it is possible to efficiently resolve constraint in the tip of the swelled part 300. As a result, fluidity of material can be further enhanced.

(3) In the method of manufacturing a branched pipe according to the first exemplary embodiment, a columnar body formed by an elastic member is used as the elastic body 81, and the inner surface of the pipe blank 200 is pressurized by compressing the columnar body in the axial direction (i.e., the center line A direction of the pipe hole $H_1$) in the first and second swelling steps.

Therefore, it is possible to uniformly pressurize the inner surface of the pipe blank 200 from the cylindrical surface of the columnar body.

(4) The branched pipe manufacturing device 100 according to the first exemplary embodiment includes the opening forming mold 60 having the opening forming portion 61 and the pressure transmission part 80 having the elastic body 81. The opening forming portion 61 is disposed along the circumferential direction C when the inside of the branched hole $H_2$ is viewed from the inside of the pipe hole $H_1$. The opening forming portion 61 is sharply protruded towards the pipe hole $H_1$.

According to the branched pipe manufacturing device 100 of the first exemplary embodiment, it is possible to form an opening along the circumferential direction C in the swelled part 300 swelled into the branched hole $H_2$ by the opening forming portion 61. Further, the swelled part 300 can be further swelled by the pressure transmission part 80 after the opening is formed. Therefore, it is possible to enhance fluidity of material from the opening as a base point, and accordingly, it is possible to promote growth of the swelled part 300. As a result, it is possible to increase the swelled width W of the swelled part 300 swelled from the main body 250.

Further, the opening forming portion 61 is disposed along the circumferential direction C, and thereby an opening is formed in an elongated shape along the circumferential direction C. Therefore, fluidity of material can be further enhanced than, for instance, a case that the opening is formed as a small round hole.

Further, the pressure transmission part 80 includes the elastic body 81 as a medium for pressurizing the inner surface of the pipe blank 200. Therefore, it is possible to further inhibit leakage of the medium out of the opening than a case that liquid is used as the medium. Further, the elastic body 81 is restored to its original shape in response to release of pressurization. Therefore, the elastic body 81 can be repeatedly used as the medium.

(5) In the branched pipe manufacturing device 100 according to the first exemplary embodiment, the opening forming portion 61 is a cutting blade disposed along the circumferential direction C.

Therefore, it is possible to form the slit R along the circumferential direction C as an opening. It is thereby possible to simply and efficiently form an elongated opening.

(6) In the branched pipe manufacturing device 100 according to the first exemplary embodiment, the opening forming mold 60 includes the groove portion 63 disposed along the opening forming portion 61 when viewed from the inside of the pipe hole $H_1$.

Therefore, the annular portion P can be locally swelled into the groove portion 63. Therefore, the swelled part 300 can be thinned at the annular recess Q in a pinpoint manner, and thereby the opening can be thereby efficiently formed.

(7) In the branched pipe manufacturing device 100 of the first exemplary embodiment, the elastic body 81 is a columnar body formed by an elastic member. The pressure transmission part 80 is configured to axially compress the columnar body for pressurizing the inner surface of the pipe blank 200.

Therefore, it is possible to uniformly pressurize the inner surface of the pipe blank 200 from the cylindrical surface of the columnar body.

Second Embodiment

Structure of Branched Pipe Manufacturing Device 100

Figure 17:
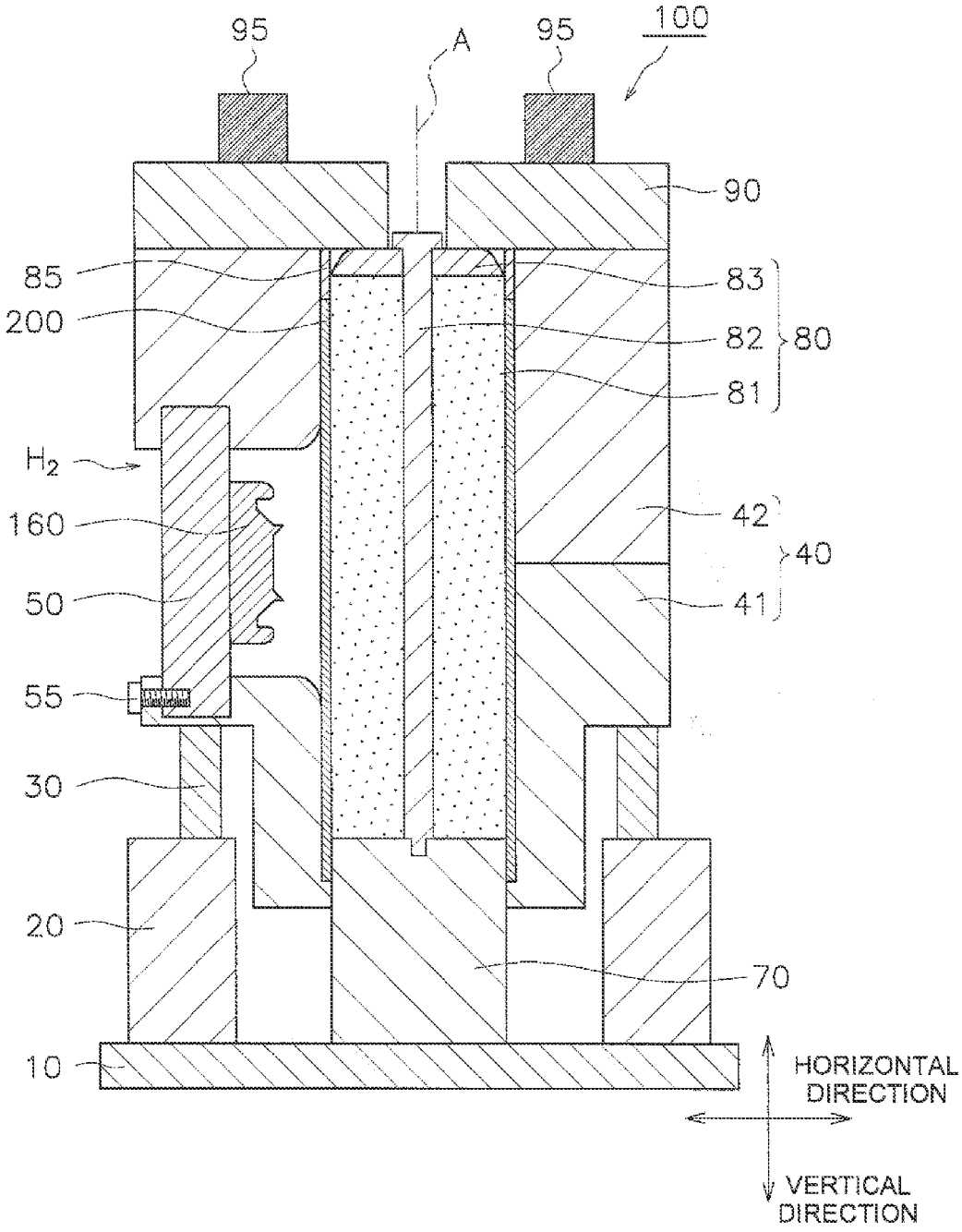
FIG. 17 is a cross-sectional view of the structure of the branched pipe manufacturing device 100 according to a second exemplary embodiment.

The structure of the branched pipe manufacturing device 100 according to a second exemplary embodiment will be hereinafter explained with reference to figures. FIG. 17 is a cross-sectional view of the structure of the branched pipe manufacturing device 100 according to the second exemplary embodiment.

The branched pipe manufacturing device 100 of the present exemplary embodiment is different from that of the first exemplary embodiment in the structure of an opening forming mold 160. Differences from the first exemplary embodiment will be hereinafter mainly explained.

Structure of Opening Forming Mold 160

Figure 18:
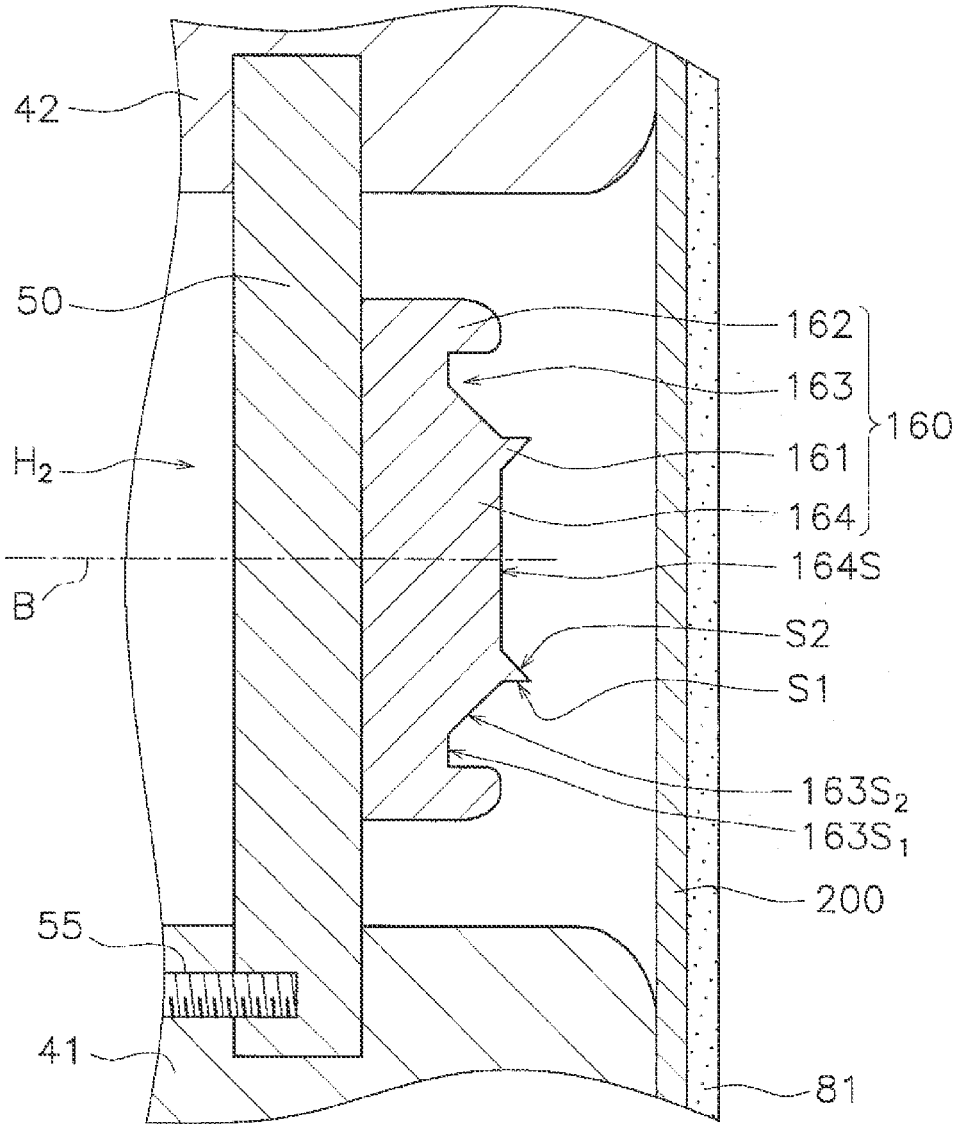
FIG. 18 is a partial enlarged view of FIG. 17.

FIG. 18 is a partial enlarged view of FIG. 17.

The opening forming mold 160 includes an opening forming portion 161, a protruding portion 162, a groove portion 163 and a contact portion 164.

The opening forming portion 161 has the same structure as the opening forming portion 61 according to the aforementioned first exemplary embodiment. In short, the opening forming portion 161 is a cutting blade formed along the circumferential direction C (see FIG. 4) about the center line B of the branched hole $H_2$ when the inside of the branched hole $H_2$ is viewed from the inside of the pipe hole $H_1$. Specifically; the opening forming portion 161 is formed by the outer peripheral surface S1 and the inner peripheral surface S2 slanted against the outer peripheral surface S1 at an acute angle.

The protruding portion 162 is disposed along the groove portion 162 on the opposite side of the opening forming portion 161 through the groove portion 163. The protruding portion 162 is protruded towards the pipe hole $H_1$. The protruding portion 162 is annularly formed for enclosing the outside of the opening forming portion 161.

The groove portion 163 is disposed outside the opening forming portion 161 in relation to the center line B of the branched hole $H_2$ as a reference. In other words, the groove portion 163 is annularly formed along the circumferential direction C while being disposed between the opening forming portion 161 and the protruding portion 162.

Further, the groove portion 163 has a bottom surface 163$S_1$ and a lateral surface 163$S_2$. The lateral surface 163$S_2$ is a slope formed from the bottom surface 163$S_1$ towards the tip of the opening forming portion 161. In other words, the lateral surface 163$S_2$ is tapered towards the pipe hole $H_1$ and gets closer to the center line B towards the pipe hole $H_1$.

The contact portion 164 is disposed inside the opening forming portion 61. The contact portion 164 has a contact surface 164S arranged perpendicular to the center line B of the branched hole $H_2$.

The contact surface 164S is a flat surface extended perpendicularly to the center line B and is continued to the inner peripheral surface S2 of the opening forming portion 161.

Method of Manufacturing Branched Pipe

Next, a method of manufacturing a branched pipe according to the second exemplary embodiment will be explained with reference to figures. Differences from the first exemplary embodiment will be hereinafter mainly explained.

First, the inner surface of the pipe blank 200 is pressurized by the elastic body 81 for swelling the swelled part 300 from the main body 250 of the pipe blank 200.

Figure 19:
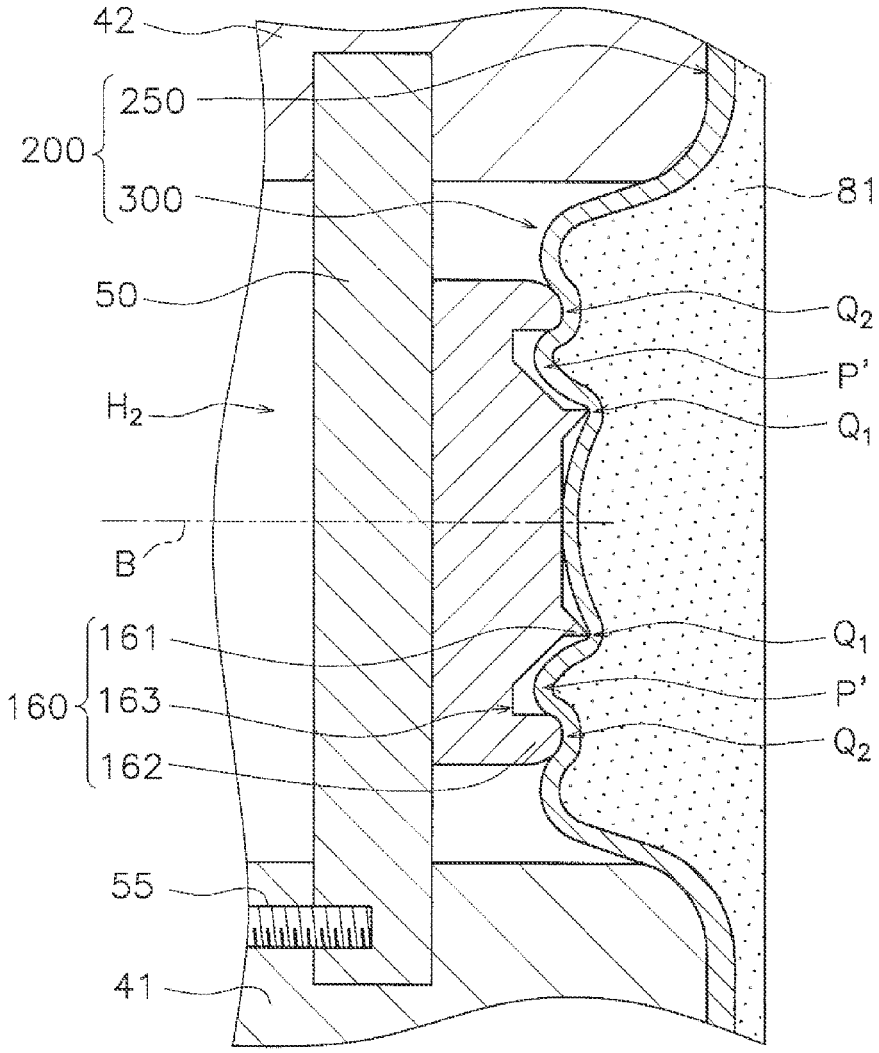
FIG. 19 is a diagram for explaining a method of manufacturing a branched pipe according to the second exemplary embodiment.

FIG. 19 is herein a partial enlarged view illustrating a state that the tip portion of the swelled part 300 is pressed onto the opening forming mold 160.

A part of the swelled part 300, ranging from a contact portion with the opening forming portion 161 to a contact portion with the protruding portion 162 (hereinafter referred to as "an annular portion P'"), starts swelling to the inside of the groove portion 163. Simultaneously, the inner edge of the annular portion P' is pressed onto the opening forming portion 161 and an annular recess $Q_1$ is thereby formed. Further, the outer edge of the annular portion P' is pressed onto the protruding portion 162 and an annular recess $Q_2$ is thereby formed. Thus, deformation allowance of the annular portion P' is provided within the groove portion 163, while material flow to the annular portion P' is restricted not only at the annular recess $Q_1$ but also at the annular recess $Q_2$. Therefore, the swelled part 300 is thinned at the annular recess $Q_1$ in a pinpoint manner.

Next, the inner surface of the pipe blank 200 is further pressurized by the elastic body 81, and thereby an opening is formed along the annular recess $Q_1$ in the tip portion of the swelled part 300 (hereinafter referred to as "a first swelling step"). Subsequently, the inner surface of the pipe blank 200 is further pressurized by the elastic body 81, and thereby the swelled part 300 is further swelled protruded (hereinafter referred to as "a second swelling step").

Figure 20:
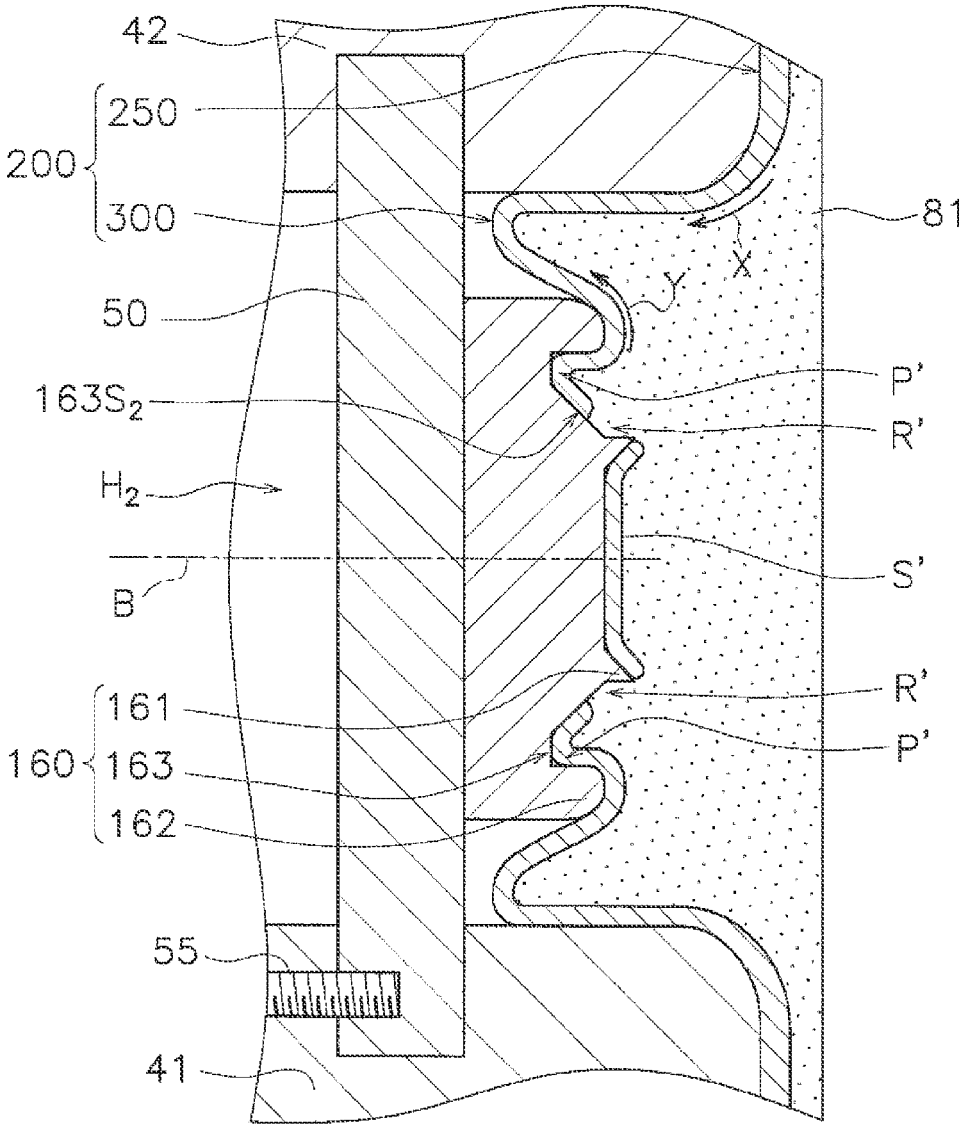
FIG. 20 is a diagram for explaining the method of manufacturing a branched pipe according to the second exemplary embodiment.

FIG. 20 is herein a partial enlarged view illustrating a state that the swelled part is swelled after the opening is formed in the tip portion of the swelled part 300.

The inner edge of the annular portion P' is pressed onto and cut by the opening forming portion 61. Accordingly, a slit R' is funned along the circumferential direction C in the tip portion of the swelled part 300. The inner edge of the annular portion P' is herein pressed onto the lateral surface 163$S_2$ of the groove portion 163.

Further, the inner edge of the annular portion P' is cut away from a disc portion S', and thereby the swelled part 300 grows without being restricted by the disc portion S'. The annular portion P' is herein outwardly pulled about the center line B of the branched hole $H_2$. Therefore, material flow (depicted with an arrowed direction Y) from the annular portion P' as well as material flow (depicted with an arrowed direction X) from the main body 250 occurs.

Actions and Effects (1) In the branched pipe manufacturing device 100 according to the second exemplary embodiment, the groove portion 163 is disposed outwards of the opening forming portion 161 in relation to the center line B of the branched hole $H_2$ as a reference. The groove portion 163 has the lateral surface 163$S_2$ slanting towards the tip of the opening forming portion 161 from the bottom surface 163$S_1$.

With the structure, when the opening (the slit R') is formed in the swelled part 300, the inner edge of the annular portion P' is quickly pressed onto the lateral surface 163$S_2$ of the groove portion 163. Therefore, it is possible to further inhibit a clearance from being produced between the inner edge of the annular portion P' and the lateral surface 163$S_2$, compared to the structure that the lateral surface 163$S_2$ is arranged perpendicularly to the bottom surface 163$S_1$. As a result, it is possible to inhibit leakage of the elastic member forming the elastic body 81 from the opening.

(2) In the branched pipe manufacturing device 100 according to the second exemplary embodiment, the opening forming mold 160 includes the protruding portion 162. The protruding portion 162 is disposed on the opposite side of the opening forming portion 161 through the groove portion 163.

With the structure, the annular recess $Q_1$ is fanned on the inner edge of the annular portion P' while the annular recess $Q_2$ is formed on the outer edge of the annular portion P'. Therefore, material flow to the annular portion P' can be restricted in the annular recess $Q_2$ as well as in the annular recess $Q_1$. As a result, the opening can be efficiently formed along the annular recess $Q_1$.

(3) In the branched pipe manufacturing device 100 according to the second exemplary embodiment, the opening forming portion 161 is disposed inside the protruding portion 161 and the groove portion 163.

With the structure, an opening is formed along the inner edge of the annular portion P'. Therefore, material flow (see especially the arrowed direction Y in FIG. 20) can be flintier promoted in the second swelling step, compared to the structure that an opening is formed along the inner edge of the annular portion P'. As a result, it is possible to further increase the swelled width W of the swelled part 300 swelled from the main body 250.

OTHER EXEMPLARY EMBODIMENTS

The present invention has been described with the aforementioned exemplary embodiments, but it should not be understood that the description and figures, forming a part of this disclosure, are intended to limit the present invention. A variety of alternative embodiments, examples and operational arts would be apparent for a person skilled in the art from this disclosure.

(A) In the aforementioned exemplary embodiments, the opening forming mold 60 or 160 includes the opening forming portion 61 or 161 formed in an annular shape along the circumferential direction C, but the present invention is not limited to the above. The opening forming portion 61 or 161 is only required to be at least partially formed along a predetermined direction when viewed from the inside of the pipe hole $H_1$.

Figure 21:
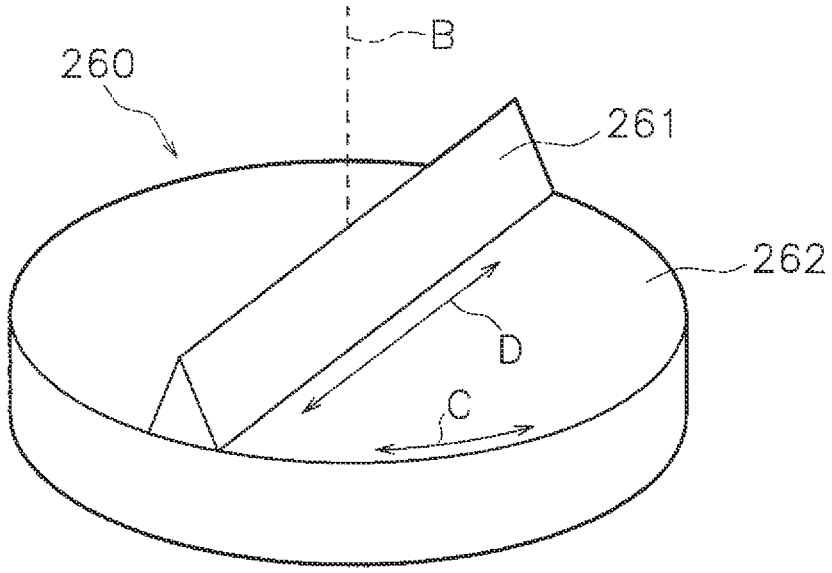
FIG. 21 is a perspective view of the structure of an opening forming mold 260 according to an exemplary embodiment.

FIG. 21 is a perspective view of the structure of an opening forming mold 260. As illustrated in FIG. 21, the opening forming mold 260 includes an opening forming portion 261 and a base 262. The opening forming portion 261 is formed along a radial direction D arranged perpendicularly to the center line B of the branched hole $H_2$.

Figure 22:
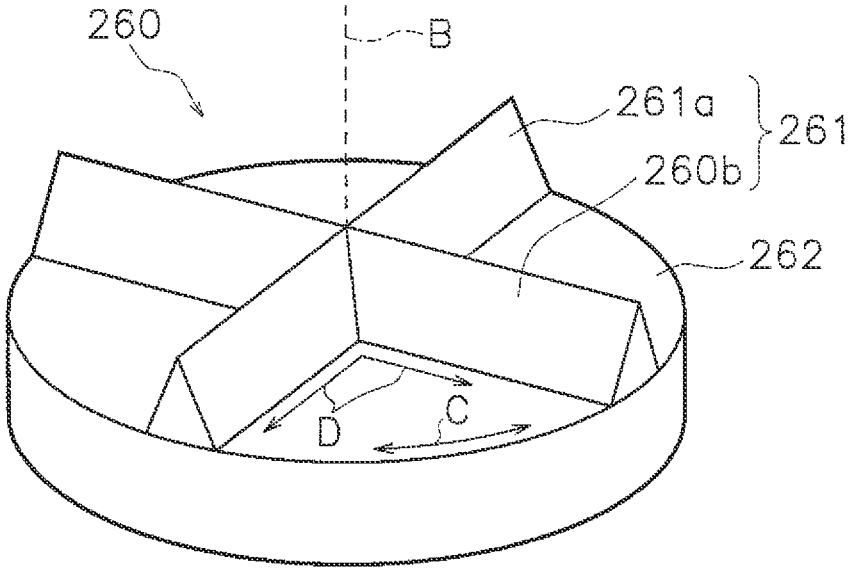
FIG. 22 is a perspective view of the structure of the opening forming mold 260 according to an exemplary embodiment.

FIG. 22 is a perspective view of the structure of another opening forming mold 260. As illustrated in FIG. 22, the opening forming mold 260 includes an opening forming portion 261 and a base 262. The opening forming portion 261 is formed by a first opening forming portion 261*a* and a second opening forming portion 261*b*. Each of the first and second opening forming portions 261*a* and 261*b* is formed along a radial direction D arranged perpendicularly to the center line B of the branched hole $H_2$.

It should be noted that the opening forming portion 61, 161 or 261 may be directly disposed on the basal part 50 although not illustrated in the figures.

(B) In the aforementioned exemplary embodiments, the opening forming portions 61 or 161 function as a cutting blade, but the present invention is not limited to the above. The opening forming portion 61 or 161 may be formed by a plurality of cones aligned along the aforementioned predetermined direction.

Figure 23:
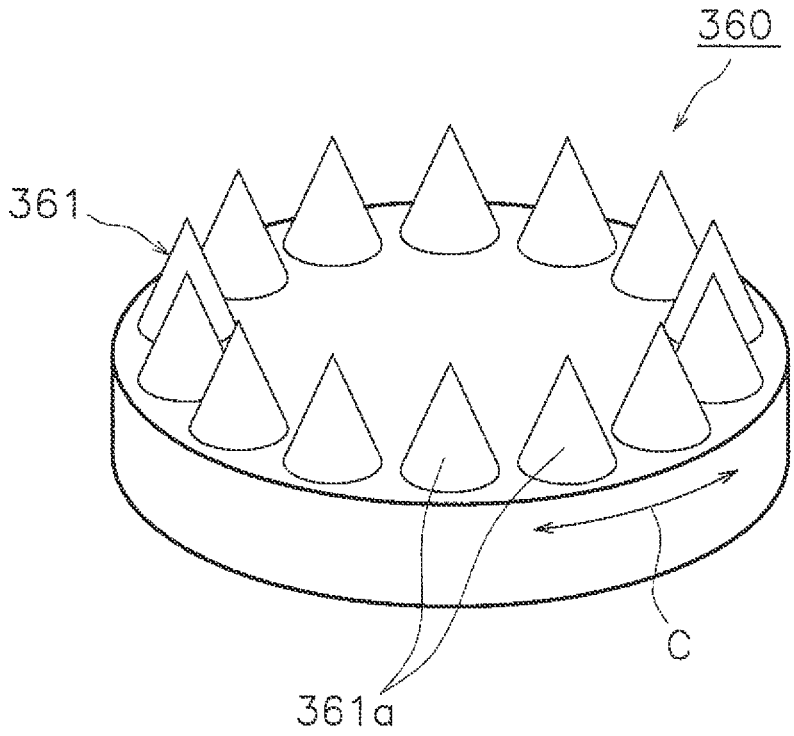
FIG. 23 is a perspective view of the structure of an opening forming mold 360 according to an exemplary embodiment.

FIG. 23 is a perspective view of the structure of an opening forming mold 360. As illustrated in FIG. 23, the opening forming mold 360 includes an opening forming portion 361 and a base 362. The opening forming mold 361 is formed by a plurality of cones 361*a*. The cones 361*a* are aligned along the circumferential direction C. Each of the plural cones 361*a* is a circular cone sharply protruded towards the pipe hole $H_1$.

According to the opening forming mold 360 thus structured, it is possible to form a plurality of holes along the circumferential direction C as openings in the first swelling step. Subsequently in the second swelling step, the openings (i.e., the respective plural holes intermittently formed) are expanded and integrated with adjacent openings, and a slit is thereby thrilled.

Therefore, material can flow from the opening as a base point and growth of the swelled part 300 can be thereby promoted. As a result, it is possible to increase the swelled width W of the swelled part 300.

Further, the plural holes are formed as openings, and thereby the openings can be easily formed with a pressure less than that required to form a slit at one time.

(C) in the aforementioned exemplary embodiment, the opening forming mold 60 is designed to include the groove portion 63. However, the opening forming mold 60 may not include the groove portion 63 (see FIGS. 21 and 22).

(D) in the aforementioned exemplary embodiments, the opening forming mold 60 or 160 is designed to be fixed to the basal part 50. However, the opening forming mold 60 or 160 may be directly fixed to the shaping die 40.

(E) In the aforementioned exemplary embodiment, the inner angle D of the opening forming portion 61 is set to be an acute angle, but the present invention is not limited to the above. The opening forming portion 61 is only required to have a sharp edge, and therefore, desired advantageous effects can be achieved even when the inner angle D is a right angle or an obtuse angle.

(F) Although not particularly described in the aforementioned exemplary embodiments, the height of the opening forming portion 61 may be roughly the same as that of the contact portion 62 in a direction along the center line B of the branched hole $H_2$. Likewise, the height of the opening forming portion 161 may be roughly the same as that of the protruding portion 162 in a direction along the center line B of the branched hole $H_2$.

(G) In the aforementioned exemplary embodiment, the elastic body 81 is designed to be a column formed by an elastic member, but the present invention is not limited to the above.

The elastic body 81 may be a pouch-shaped body that is formed by an elastic member and liquid can be injected into the inside thereof. The pressure transmission part 80 is herein required to pressurize the inner surface of the pipe blank 200 by injecting liquid into the pouch-shaped body Therefore, the branched pipe manufacturing device 100 may not herein include the actuator, the piston 70 and etc.

It should be noted that the elastic body may be a polygonal column formed by an elastic member.

(H) In the aforementioned exemplary embodiment, the branched pipe manufacturing device 100 is designed to include the single piston 70 that is caused to make contact with an end of the elastic body 81, but the present invention is not limited to the above. The branched pipe manufacturing device 100 may include a pair of the pistons 70 that are caused to make contact with the both ends of the elastic body 81.

(I) In the aforementioned exemplary embodiment, the pipe blank 200 in itself is configured to be axially compressed when the inner surface thereof is pressurized by the elastic body 81, but the present invention is not limited to the above. Without compression of the pipe blank 200 in itself, the swelled part 300 may be formed.

(J) In the aforementioned exemplary embodiments, the shaping die 40 is designed to be formed by the bottom die 41 and the top die 42, but the present invention is not limited to the above. The shaping die 40 may be designed to be arbitrarily disassembled as long as it is possible to take out the pipe blank 200 on which the swelled part 300 is formed.

It is thus apparent that the present invention includes a variety of embodiments and etc. not herein described. Therefore, the technical scope of the present invention should be defined only by the matters specifying the invention related to claims that are valid from the aforementioned explanation.

The illustrated embodiments can be utilized in the field of manufacturing branched pipes.

The invention claimed is:

1. A method of manufacturing a branched pipe comprising:

an elastic body loading step of loading an elastic body in an inside of a cylindrical pipe blank, which is inserted into a support structure;

a first swelling step of swelling a swelled part formed by partially swelling a side portion of a main body of the pipe blank outward in a radial direction of the pipe blank through pressurization of an inner surface of the pipe blank by the elastic body, and simultaneously forming an opening in a tip portion of the swelled part along a predetermined direction; and a second swelling step of further swelling the swelled part from the main body through pressurization of the inner surface of the pipe blank by the elastic body after execution of the first swelling step, and simultaneously folding a periphery of the opening inward toward a center of the opening, the first swelling step including forming a slit along the predetermined direction as the opening.

2. The method of claim 1, wherein the first swelling step includes forming the opening in an annular shape.

3. The method of claim 1, wherein the elastic body is a columnar body formed by an elastic member, and the first swelling step and the second swelling step include pressurizing the inner surface of the pipe blank by compressing the columnar body in an axial direction.

4. The method of claim 1, wherein the first swelling step includes:

a step of enclosing the pipe blank in a cylindrical pipe hole provided in said support structure, which is a shaping die, and a step of forming the swelled part by swelling the side portion of the main body of the pipe blank into a cylindrical branched hole provided in the shaping die such that the branched hole extends outwards from the pipe hole, and forming the opening with an opening forming mold that is arranged in the branched hole configured to protrude sharply towards the pipe hole.

5. A method of manufacturing a branched nine comprising:

an elastic body loading step of loading an elastic body in an inside of a cylindrical pipe blank, which is inserted into a support structure;

a first swelling step of swelling a swelled part formed by partially swelling a side portion of a main body of the pipe blank outward in a radial of the pipe blank through pressurization of an inner surface of the pipe blank by the elastic body, and simultaneously forming a plurality of holes along the predetermined direction in a tip portion of the swelled part; and a second swelling step of further swelling the swelled part from the main body through pressurization of the inner surface of the pipe blank by the elastic body after execution of the first swelling step, the plurality of holes forming a slit along the predetermined direction as the holes expand during the second swelling step.

* * * * *